US008574334B2

(12) United States Patent
Uno

(10) Patent No.: US 8,574,334 B2
(45) Date of Patent: Nov. 5, 2013

(54) MAT, HOLDING SEALING MATERIAL, METHOD FOR PRODUCING MAT, AND EXHAUST GAS PURIFYING APPARATUS

(75) Inventor: Ryoji Uno, Gifu (JP)

(73) Assignee: Ibiden Co., Ltd., Ogaki-shi (JP)

( * ) Notice: Subject to any disclaimer, the term of this patent is extended or adjusted under 35 U.S.C. 154(b) by 0 days.

(21) Appl. No.: 13/246,920

(22) Filed: Sep. 28, 2011

(65) Prior Publication Data

US 2012/0124952 A1 May 24, 2012

(30) Foreign Application Priority Data

Sep. 30, 2010 (JP) ..... 2010-222206

(51) Int. Cl.

| | |
|---|---|
| ***B01D 39/14*** | (2006.01) |
| ***B01D 39/06*** | (2006.01) |
| ***B01D 24/00*** | (2006.01) |
| ***B01D 50/00*** | (2006.01) |
| ***F01N 3/00*** | (2006.01) |

(52) U.S. Cl.

USPC ..... 55/523; 55/522; 55/524; 422/168; 422/169; 422/170; 422/171; 422/172; 422/177; 422/178; 422/179; 422/180; 422/181; 422/182; 60/297

(58) Field of Classification Search

USPC ..... 55/522–524; 422/177–182, 168–172; 60/297

See application file for complete search history.

(56) References Cited

U.S. PATENT DOCUMENTS

| | | | | |
|---|---|---|---|---|
| 6,967,006 | B1 * | 11/2005 | Wirth et al. | 422/179 |
| 7,442,347 | B2 * | 10/2008 | Yoshimi et al. | 422/179 |
| 2003/0049180 | A1 * | 3/2003 | Fukushima | 422/168 |
| 2006/0166584 | A1 * | 7/2006 | Yoshimi et al. | 442/403 |
| 2007/0081926 | A1 * | 4/2007 | Okabe | 422/177 |

FOREIGN PATENT DOCUMENTS

| | | |
|---|---|---|
| EP | 1696110 | 8/2006 |
| JP | 2006-207393 | 8/2006 |
| JP | 2007-127112 | 5/2007 |
| JP | 2010-096171 | 4/2010 |

* cited by examiner

*Primary Examiner* — Amber Orlando

(74) *Attorney, Agent, or Firm* — Ditthavong Mori & Steiner, P.C.

(57) ABSTRACT

A mat includes inorganic fibrous substances, first and second main faces, first and second side faces and intertwined portions. The intertwined portions respectively extend from needle piercing points of the first main face to needle piercing points of the second main face. A first virtual straight line and each of second virtual straight lines intersect with each other at a first angle of less than about 90° when viewed from the first side face to the second side face. The first virtual straight line and each of third virtual straight lines intersect with each other at a second angle of more than about 90° when viewed from the first side face to the second side face. The second virtual straight lines and the third virtual straight lines intersect with each other at a third angle when viewed from the first side face to the second side face.

6 Claims, 11 Drawing Sheets

J-J line cross-sectional view

K-K line cross-sectional view

A–A line cross-sectional view

B–B line cross-sectional view

F-F line cross-sectional view

H-H line cross-sectional view

I-I line cross-sectional view

MAT, HOLDING SEALING MATERIAL, METHOD FOR PRODUCING MAT, AND EXHAUST GAS PURIFYING APPARATUS

CROSS-REFERENCE TO RELATED APPLICATIONS

The present application claims priority under 35 U.S.C. §119 to Japanese patent application JP 2010-222206 filed on Sep. 30, 2010, the contents of which are incorporated herein by reference in their entirety.

BACKGROUND OF THE INVENTION

1. Field of the Invention

The present invention relates to a mat, a holding sealing material, a method for producing a mat, and an exhaust gas purifying apparatus.

2. Discussion of the Background

Conventionally known mats include nonwoven fabric-like mats made from compressed inorganic fibrous materials such as fibrous silica or fibrous alumina. These nonwoven fabric-like mats are excellent in characteristics such as heat resistance and elasticity (repulsive force), and thus they are used for various applications.

For example, such a nonwoven fabric-like mat is used as a component of an exhaust gas purifying apparatus. Specifically, a typical exhaust gas purifying apparatus comprises a cylindrical exhaust gas treating body, a cylindrical casing which accommodates the exhaust gas treating body, and a mat-shaped holding sealing material disposed between the exhaust gas treating body and the casing, and the nonwoven fabric-like mat is used as a material for this holding sealing material. The holding sealing material is produced through steps such as a step of cutting a nonwoven fabric-like mat into a predetermined shape.

The holding sealing material which comprises a nonwoven fabric-like mat having repulsive force has a predetermined holding force. Thus, in the exhaust gas purifying apparatus, the holding sealing material securely holds the exhaust gas treating body at a predetermined position inside the casing. Further, since the holding sealing material is disposed between the exhaust gas treating body and the casing, the exhaust gas treating body is less likely to be in contact with the casing even if vibration or the like is applied, and exhaust gas is less likely to leak from between the exhaust gas treating body and the casing.

The exhaust gas purifying apparatus comprising a holding sealing material may be produced by stuffing an exhaust gas treating body wrapped with a holding sealing material into a casing.

Specifically, a holding sealing material is wrapped around the periphery of a cylindrical exhaust gas treating body to prepare a wrapped member, and the wrapped member is slide-inserted into a cylindrical casing whose inner diameter is smaller than the outer diameter of the wrapped member while the holding sealing material is compressed.

In this production method, therefore, the holding sealing material wrapped around the exhaust gas treating body is required to have an appropriately low height (volume) so that the wrapped member is easily stuffed.

Further, a high shearing force is applied to the holding sealing material when the holding sealing material is stuffed into the casing. Thus, the holding sealing material is required to have a certain degree of strength (hereinafter, also referred to simply as shear strength) so as not to be torn due to the shearing force.

JP-A 2006-207393 and JP-A 2007-127112 each disclose a conventional nonwoven fabric-like mat comprising an inorganic fibrous substance. These conventional nonwoven fabric-like mats are produced as follows: a fibrous alumina precursor, which is to be converted into an inorganic fibrous substance by firing, is compressed to prepare a sheet; multiple needles with barbs are inserted into/extracted from the sheet in the thickness direction of the sheet to prepare a needled sheet with multiple intertwined portions formed therein; and the needled sheet is fired.

The produced nonwoven fabric-like mat is cut into a predetermined shape, and thereby a holding sealing material is produced.

The contents of JP-A 2006-207393 and JP-A 2007-127112 are incorporated herein by reference in their entirety.

SUMMARY OF THE INVENTION

According to one aspect of the present invention, a mat includes inorganic fibrous substances, a first main face, a second main face, a first side face, a second side face and intertwined portions. The inorganic fibrous substances are intertwined with each other. The first main face is defined by the inorganic fibrous substances. The first main face includes needle piercing points. The second main face is opposite to the first main face and is defined by the inorganic fibrous substances. The second main face includes needle piercing points. The first side face is defined by the inorganic fibrous substances. The second side face is opposite to the first side face and is defined by the inorganic fibrous substances. The intertwined portions each is formed by inorganic fibrous substances being more closely intertwined with each other than inorganic fibrous substances in a portion except the intertwined portions. The intertwined portions respectively extend from the needle piercing points of the first main face to the needle piercing points of the second main face. The mat further includes a first virtual straight line defined along a direction perpendicular to a thickness direction of the mat, second virtual straight lines respectively defined along the first intertwined portions, and third virtual straight lines respectively defined along the second intertwined portions. The first virtual straight line and each of the second virtual straight lines intersect with each other at a first angle of less than about 90° when viewed from the first side face to the second side face, the first virtual straight line and each of the third virtual straight lines intersect with each other at a second angle of more than about 90° when viewed from the first side face to the second side face, and the second virtual straight lines and the third virtual straight lines intersect with each other at a third angle when viewed from the first side face to the second side face.

According to another aspect of the present invention, a holding sealing material includes a mat. The mat includes inorganic fibrous substances, a first main face, a second main face, a first side face, a second side face and intertwined portions. The inorganic fibrous substances are intertwined with each other. The first main face is defined by the inorganic fibrous substances. The first main face includes needle piercing points. The second main face is opposite to the first main face and is defined by the inorganic fibrous substances. The second main face includes needle piercing points. The first side face is defined by the inorganic fibrous substances. The second side face is opposite to the first side face and is defined by the inorganic fibrous substances. The intertwined portions each is formed by inorganic fibrous substances being more closely intertwined with each other than inorganic fibrous substances in a portion except the intertwined portions. The intertwined portions respectively extend from the needle piercing points of the first main face to the needle piercing points of the second main face. The mat further includes a first virtual straight line defined along a direction perpendicular to a thickness direction of the mat, second virtual straight lines respectively defined along the first intertwined portions, and third virtual straight lines respectively defined along the second intertwined portions. The first virtual straight line and each of the second virtual straight lines intersect with each other at a first angle of less than about 90° when viewed from the first side face to the second side face, the first virtual straight line and each of the third virtual straight lines intersect with each other at a second angle of more than about 90° when viewed from the first side face to the second side face, and the second virtual straight lines and the third virtual straight lines intersect with each other at a third angle when viewed from the first side face to the second side face.

According to further aspect of the present invention, a method for producing a mat includes: preparing a sheet including inorganic fibrous substance precursors intertwined with each other, a first main face, a second main face opposite to the first main face, a first side face, and a second side face opposite to the first side face, the first and second main faces and the first and second side faces being each defined by the inorganic fibrous substance precursors; piercing the sheet with first needles to form first intertwined portion precursors, in such a manner that the first needles intersect with a first virtual straight line at a first angle of less than about 90° when viewed from the first side face to the second side face, the first virtual straight line being defined along a direction perpendicular to a thickness direction of the sheet; piercing the sheet with second needles to form second intertwined portion precursors, in such a manner that the second needles intersect with the first virtual straight line at a second angle of more than about 90° and intersect with second virtual straight lines at a third angle when viewed from the first side face to the second side face, the second virtual straight lines being respectively defined along the first intertwined portion precursors; and firing the sheet to convert the inorganic fibrous substance precursors into inorganic fibrous substances after the piercing of the sheet with the first and second needles.

According to the other aspect of the present invention, an exhaust gas purifying apparatus includes an exhaust gas treating body, a casing and a holding sealing material. The casing accommodates the exhaust gas treating body. The holding sealing material is disposed between the exhaust gas treating body and the casing and holds the exhaust gas treating body. The holding sealing material includes a mat. The mat includes inorganic fibrous substances, a first main face, a second main face, a first side face, a second side face and intertwined portions. The inorganic fibrous substances are intertwined with each other. The first main face is defined by the inorganic fibrous substances. The first main face includes needle piercing points. The second main face is opposite to the first main face and is defined by the inorganic fibrous substances. The second main face includes needle piercing points. The first side face is defined by the inorganic fibrous substances. The second side face is opposite to the first side face and is defined by the inorganic fibrous substances. The intertwined portions each is formed by inorganic fibrous substances being more closely intertwined with each other than inorganic fibrous substances in a portion except the intertwined portions. The intertwined portions respectively extend from the needle piercing points of the first main face to the needle piercing points of the second main face. The mat further includes a first virtual straight line defined along a direction perpendicular to a thickness direction of the mat, second virtual straight lines respectively defined along the first intertwined portions, and third virtual straight lines respectively defined along the second intertwined portions. The first virtual straight line and each of the second virtual straight lines intersect with each other at a first angle of less than about 90° when viewed from the first side face to the second side face, the first virtual straight line and each of the third virtual straight lines intersect with each other at a second angle of more than about 90° when viewed from the first side face to the second side face, and the second virtual straight lines and each of the third virtual straight lines intersect with each other at a third angle when viewed from the first side face to the second side face.

According to further aspect of the present invention, an exhaust gas purifying apparatus includes an exhaust gas treating body, a casing and a holding sealing material. The casing accommodates the exhaust gas treating body. The holding sealing material is disposed between the exhaust gas treating body and the casing and holds the exhaust gas treating body. The holding sealing material includes a mat produced by a method including: preparing a sheet including inorganic fibrous substance precursors intertwined with each other, a first main face, a second main face opposite to the first main face, a first side face, and a second side face opposite to the first side face, the first and second main faces and the first and second side faces being each defined by the inorganic fibrous substance precursors; piercing the sheet with first needles to form first intertwined portion precursors, in such a manner that the first needles intersect with a first virtual straight line at a first angle of less than about 90° when viewed from the first side face to the second side face, the first virtual straight line being defined along a direction perpendicular to a thickness direction of the sheet; piercing the sheet with second needles to form second intertwined portion precursors, in such a manner that the second needles intersect with the first virtual straight line at a second angle of more than about 90° and intersect with second virtual straight lines at a third angle when viewed from the first side face to the second side face, the second virtual straight lines being respectively defined along the first intertwined portion precursors; and firing the sheet to convert the inorganic fibrous substance precursors into inorganic fibrous substances after the piercing of the sheet with the first and second needles.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1A:
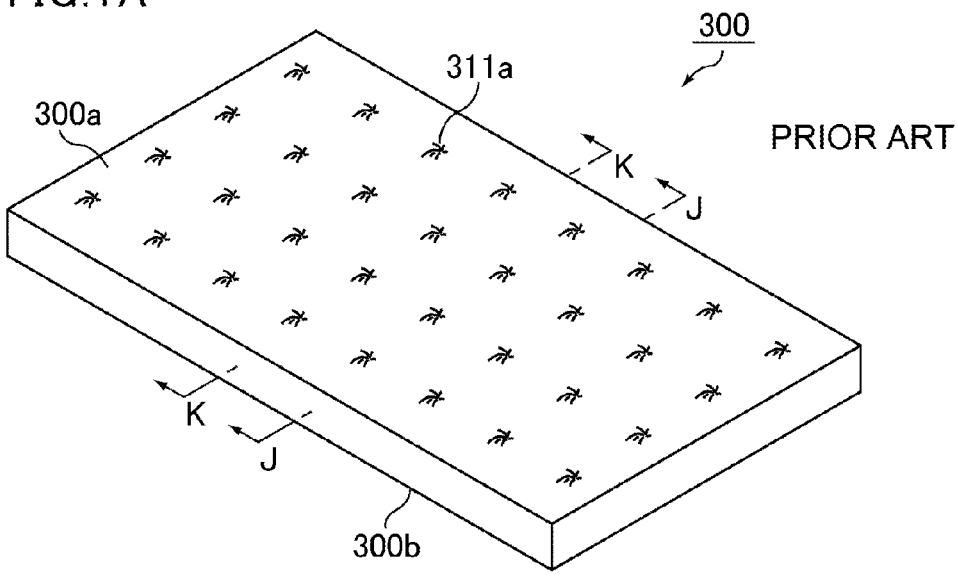
FIG. 1A is a perspective view schematically illustrating one example of a conventional mat.

The embodiments will now be described with reference to the accompanying drawings, wherein like reference numerals designate corresponding or identical elements throughout the various drawings.

Those conventional nonwoven fabric-like mats taught in JP-A 2006-207393 and JP-A 2007-127112 are not considered to have sufficiently high shear strength.

The reasons therefor are described below in detail with reference to drawings.

Figure 1B:
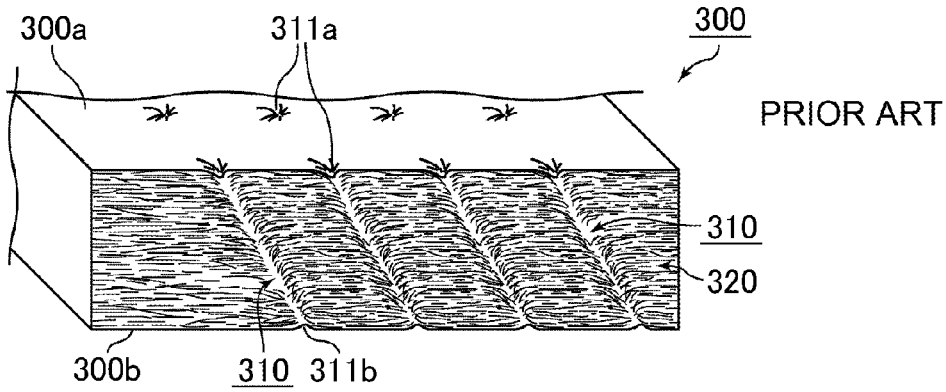
FIG. 1B is a J-J line cross-sectional view of the conventional mat illustrated in FIG. 1A.
Figure 1C:
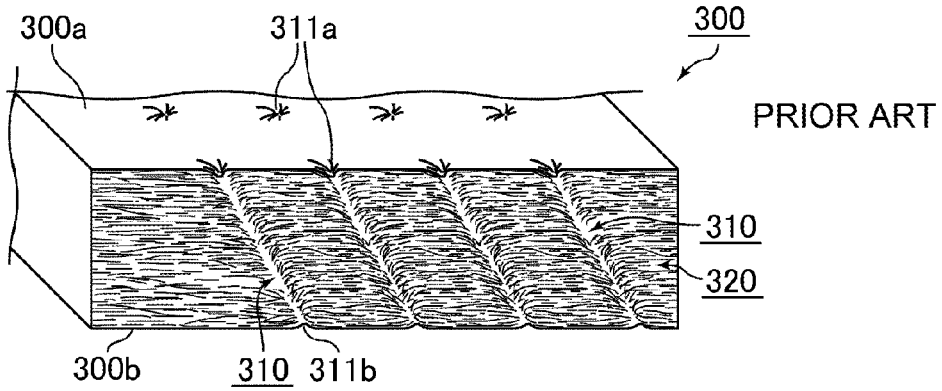
FIG. 1C is a K-K line cross-sectional view of the conventional mat illustrated in FIG. 1A.

FIG. 1A is a perspective view schematically illustrating one example of a conventional mat; FIG. 1B is a J-J line cross-sectional view of the conventional mat illustrated in FIG. 1A; and FIG. 1C is a K-K line cross-sectional view of the conventional mat illustrated in FIG. 1A.

Figure 2A:
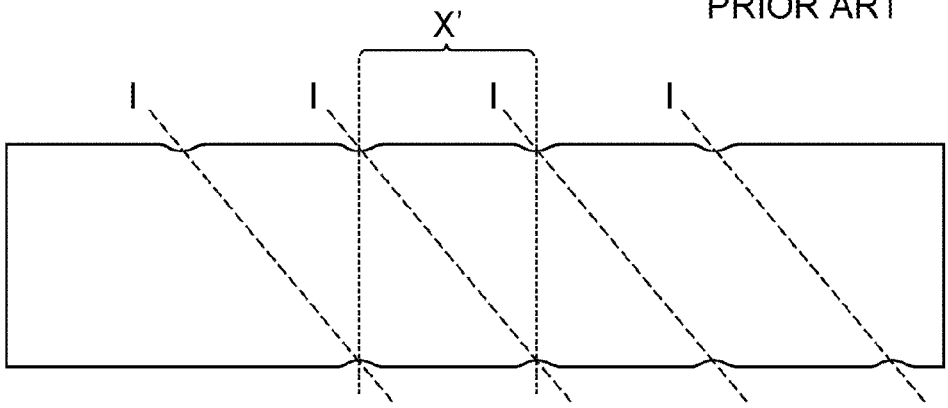
FIG.2A PRIOR ART
FIG. 2A is a side perspective view of the conventional mat illustrated in FIG. 1A from the first short side face to the second short side face.

FIG. 2A is a side perspective view of the conventional mat illustrated in FIG. 1A from a first short side face to a second short side face.

Figure 2B:
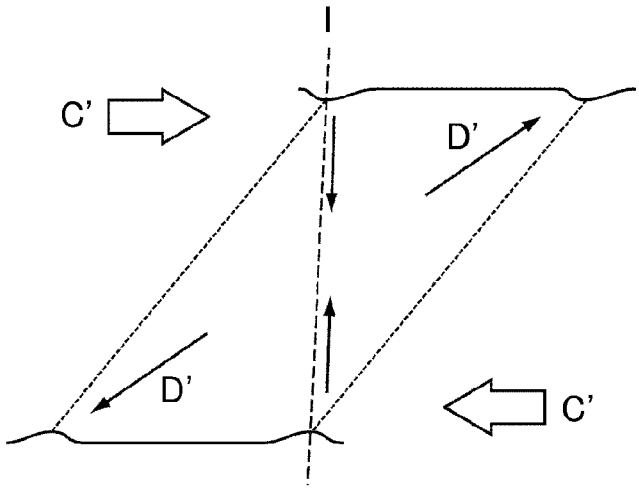
FIG.2B PRIOR ART
FIG. 2B is a partially enlarged view of a region X' in the conventional mat illustrated in FIG. 2A when a shearing force is applied to the mat.

FIG. 2B is a partially enlarged view of a region X' in the conventional mat illustrated in FIG. 2A when a shearing force is applied to the mat.

For the conventional mat illustrated in FIG. 2A and FIG. 2B, virtual straight lines drawn along later-described intertwined portions 310 are indicated by dashed lines 1.

The conventional mat 300 illustrated in FIG. 1A, FIG. 1B, and FIG. 1C contains inorganic fibrous substances 320 intertwined with each other, and is considered to be comparatively flexible.

The mat 300 includes multiple intertwined portions 310 extending from needle piercing points 311*a* on one main face 300*a* to needle piercing points 311*b* on the other main face 300*b*.

In the side perspective views from the first short side face to the second short side face opposite to the first short side face illustrated in FIG. 1B, FIG. 1C, and FIG. 2A, the virtual straight lines l drawn along the intertwined portions 310 incline at a certain angle to a direction perpendicular to the thickness direction of the mat 300 (i.e., direction of main faces 300*a* and 300*b* of the mat 300).

The inorganic fibrous substances 320 are closely intertwined with each other at the intertwined portions 310, and are therefore considered to have somewhat high shear strength compared to the case with no intertwined portions 310.

Such a mat 300 is probably not deformed easily when a comparatively low shearing force is applied to the mat 300.

The mat 300, however, probably tends to be deformed from the substantially rectangular shape into a substantially parallelogram shape when a comparatively high shearing force is applied to the mat 300 as illustrated in FIG. 2B (in FIG. 2B, arrows C' each indicate a direction of shearing force application).

Particularly when a tensile force (in FIG. 2B, arrows D' each indicate a direction of tensile force application) pulling the mat 300 from the inside to the outside is applied in the direction of the diagonal line connecting two acute angles of the parallelogram, the mat 300 probably is greatly deformed and, in some cases, damaged.

The present inventor assumes that the reason therefor is that the direction in which the tensile force is applied is different from the direction in which the intertwined portions 310 (virtual straight lines l) are formed, and thus the intertwined portions 310 cannot easily alleviate the tensile force.

As above, the conventional mats according to Patent JP-A 2006-207393 and JP-A 2007-127112 have a problem that the shear strength is not sufficiently high.

As a result of various studies to solve the above problem, the present inventor has found that it is possible to produce a mat having greatly increased shear strength by providing the mat with first intertwined portions and second intertwined portions which are inclined in a direction perpendicular to the thickness direction of the mat, and which intersect with each other at a predetermined angle in a side perspective view of the mat.

The present inventor has made further studies based on the above finding, thereby completing the mat according to the embodiment of the present invention which can solve the above problem.

That is, the mat according to an embodiment of the present invention is a mat including inorganic fibrous substances intertwined with each other, the mat having:

a first main face;

a second main face opposite to the first main face;

a first side face;

a second side face opposite to the first side face; and multiple intertwined portions each extending from a corresponding needle piercing point on the first main face to a corresponding needle piercing point on the second main face, each of the intertwined portions including inorganic fibrous substances being more closely intertwined with each other than inorganic fibrous substances in a portion except the intertwined portion, wherein assuming that the mat has a virtual straight line L1 drawn in a direction perpendicular to a thickness direction of the mat, virtual straight lines L2 drawn along first intertwined portions, and virtual straight lines L3 drawn along second intertwined portions in a perspective view of the mat from the first side face to the second side face, then the virtual straight line L1 and the virtual straight lines L2 intersect with each other at an angle α of less than about 90°, the virtual straight line L1 and the virtual straight lines L3 intersect with each other at an angle β of more than about 90°, and the virtual straight lines L2 and the virtual straight lines L3 intersect with each other at a predetermined angle γ.

The structure of the mat according to an embodiment of the present invention and the effect provided therefrom are described below in detail with reference to the drawings.

Figure 3A:
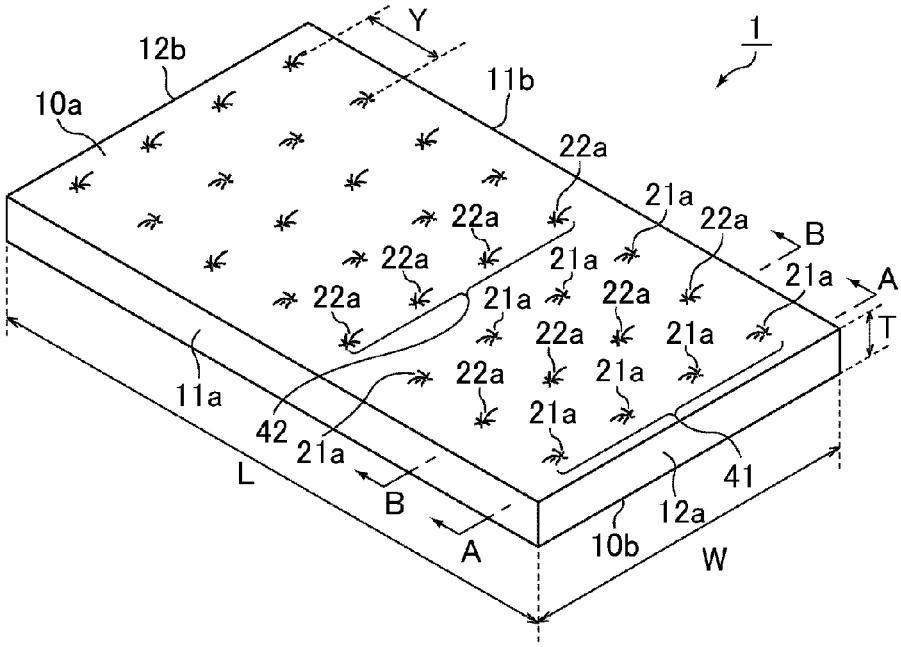
FIG. 3A is a perspective view schematically illustrating one example of the mat according to the embodiment of the present invention.
Figure 3B:
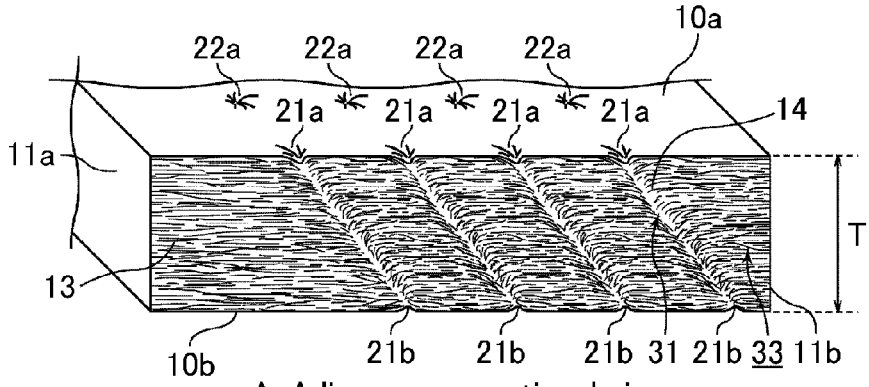
FIG. 3B is an A-A line cross-sectional view of the mat according to the embodiment of the present invention illustrated in FIG. 3A.
Figure 3C:
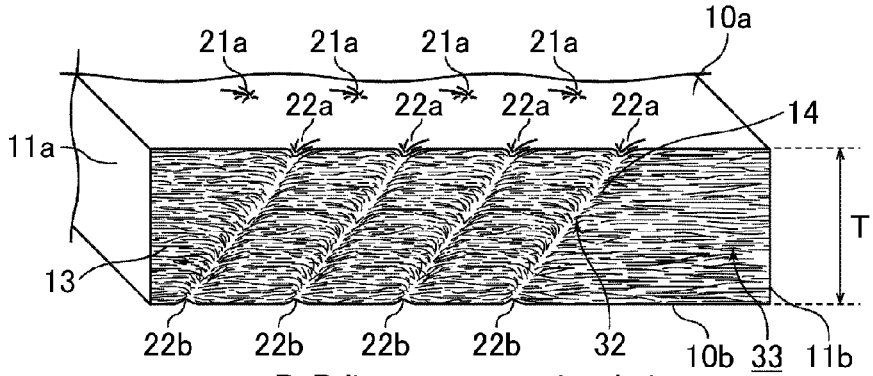
FIG. 3C is a B-B line cross-sectional view of the mat according to the embodiment of the present invention illustrated in FIG. 3A.

FIG. 3A is a perspective view schematically illustrating one example of the mat according to the embodiment of the present invention; FIG. 3B is an A-A line cross-sectional view of the mat according to the embodiment of the present invention illustrated in FIG. 3A; and FIG. 3C is a B-B line cross-sectional view of the mat according to the embodiment of the present invention illustrated in FIG. 3A.

A mat 1 according to the embodiment of the present invention illustrated in FIG. 3A is a flat plate having a predetermined thickness and having a substantially rectangular shape in a plan view.

As illustrated in FIG. 3A, the mat 1 according to the embodiment of the present invention has a first main face 10*a*; a second main face 10*b* opposite to the first main face 10*a*; a first long side face 11*a*; a second long side face 11*b* opposite to the first long side face 11*a*; a first short side face 12*a*; and a second short side face 12*b* opposite to the first short side face 12*a*.

The mat 1 according to the embodiment of the present invention includes various intertwined inorganic fibrous substances with different compositions of inorganic fibrous materials 13 and 14, such as fibrous silica, fibrous alumina-silica, and fibrous alumina.

As illustrated in FIG. 3B, the mat 1 according to the embodiment of the present invention has multiple first needle piercing points 21*a* on the first main face 10*a*, and multiple second needle piercing points 21*b* on the second main face 10*b*. From the first needle piercing points 21*a* to the respective corresponding second needle piercing points 21*b*, first intertwined portions 31 are continuously formed in a thickness direction T of the mat 1.

The mat 1 according to the embodiment of the present invention, as illustrated in FIG. 3C, also has multiple third needle piercing points 22*a* on the first main face 10*a*, and multiple fourth needle piercing points 22*b* on the second main face 10*b*. From the third needle piercing points 22*a* to the respective corresponding fourth needle piercing points 22*b*, second intertwined portions 32 are continuously formed in the thickness direction T of the mat 1.

A portion 33 other than the first intertwined portions 31 and the second intertwined portions 32 (hereinafter, such a portion is also referred to simply as a non-formation region) comprises inorganic fibrous substances 13 intertwined with each other in a relatively loose manner, and is like a nonwoven fabric.

Meanwhile, the first intertwined portions 31 and the second intertwined portions 32 comprise inorganic fibrous substances 14 intertwined with each other more closely than the inorganic fibrous substances 13 constituting the non-formation region 33.

The inorganic fibrous substances 14 closely intertwined with each other put the mat 1 in a state as if the mat 1 were securely sewn along the thickness direction, which tends to moderately reduce the height of the mat 1 toward the first intertwined portions 31 and the second intertwined portions 32.

As illustrated in FIG. 3B and FIG. 3C, the first intertwined portions 31 and the second intertwined portions 32 in the mat 1 are inclined at a predetermined angle to the first main face 10*a* and the second main face 10*b*.

Here, the first intertwined portions 31 and the second intertwined portions 32 are inclined in different directions from each other.

The mat 1 therefore tends to have sufficiently high shear strength.

The reasons therefor are described below in more detail with reference to the drawings.

Figure 4A:
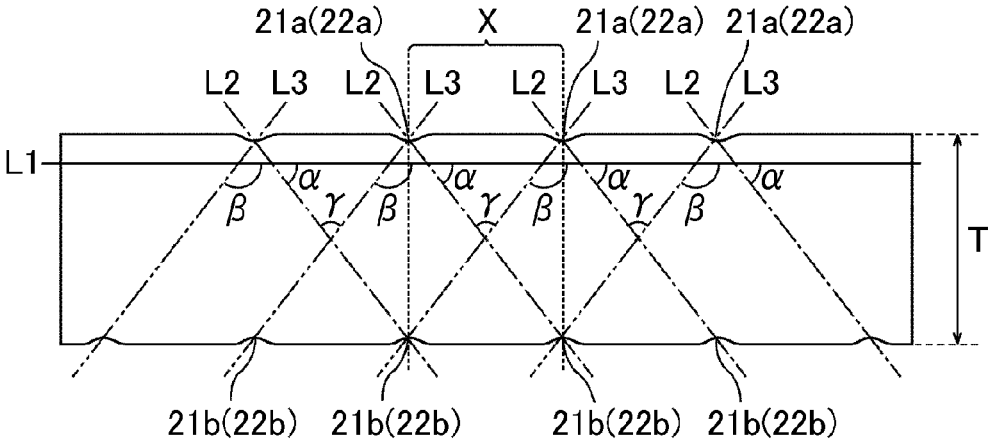
FIG. 4A is a side perspective view of the mat according to the embodiment of the present invention illustrated in FIG. 3A from the first short side face to the second short side face.

FIG. 4A is a side perspective view of the mat according to the embodiment of the present invention illustrated in FIG. 3A from the first short side face to the second short side face.

Figure 4B:
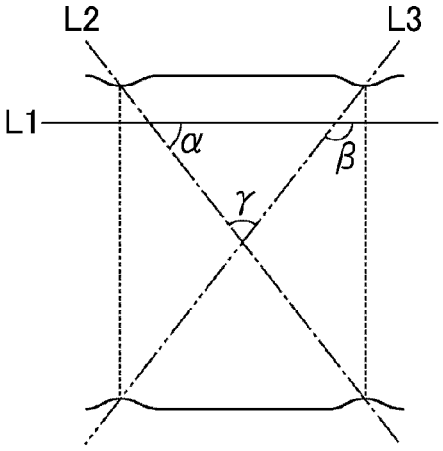
FIG. 4B is a partially enlarged view of a region X in the mat according to the embodiment of the present invention illustrated in FIG. 4A.

FIG. 4B is a partially enlarged view of a region X in the mat according to the embodiment of the present invention illustrated in FIG. 4A.

Figure 4C:
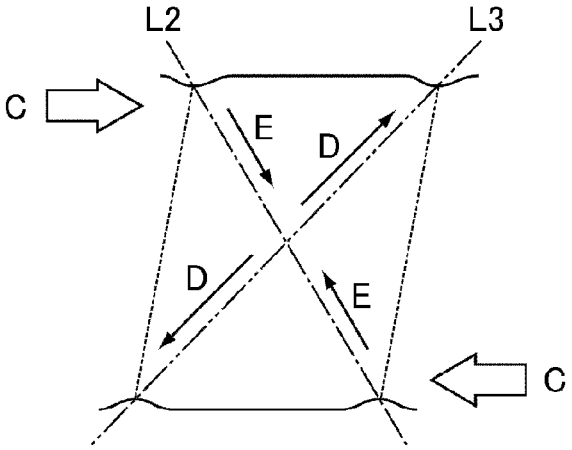
FIG. 4C is a partially enlarged view of the region X when a shearing force is applied to the mat according to the embodiment of the present invention.

FIG. 4C is a partially enlarged view of the region X when a shearing force is applied to the mat according to the embodiment of the present invention.

In the side perspective view of the mat according to the embodiment of the present invention illustrated in FIG. 4A, a virtual straight line L1 is a virtual straight line drawn in a direction perpendicular to the thickness direction T of the mat 1.

Virtual straight lines L2 are virtual straight lines drawn along the first intertwined portions 31 in the mat according to the embodiment of the present invention illustrated in FIG. 3B, and virtual straight lines L3 are virtual straight lines drawn along the second intertwined portions 32 in the mat according to the embodiment of the present invention illustrated in FIG. 3C.

As illustrated in FIG. 4A, the virtual straight line L1 and the virtual straight lines L2 intersect with each other at an angle α of less than about 90° in a perspective view of the mat 1 according to the embodiment of the present invention from the first short side face to the second short side face.

The virtual straight line L1 and the virtual straight lines L3 intersect with each other at an angle β of more than about 90°.

The virtual straight lines L2 and the virtual straight lines L3 intersect with each other at a predetermined angle γ.

The phrase "drawing virtual straight lines L2 along the first intertwined portions" herein refers to drawing virtual straight lines from the first needle piercing points 21*a* to the respective corresponding second needle piercing points 21*b* along the first intertwined portions in the side perspective view of the mat of the embodiment illustrated in FIG. 4A. That is, the virtual straight lines L2 are virtual straight lines that connect the first needle piercing points 21*a* and the respective corresponding second needle piercing points 21*b* of the mat of the embodiment.

Also, the phrase "drawing virtual straight lines L3 along the second intertwined portions" herein refers to drawing virtual straight lines from the third needle piercing points 22*a* to the respective corresponding fourth needle piercing points 22*b* along the second intertwined portions in the side perspective view of the mat of the embodiment illustrated in FIG. 4A. That is, the virtual straight lines L3 are virtual straight lines that connect the third needle piercing points 22*a* and the respective corresponding fourth needle piercing points 22*b* of the mat of the embodiment.

FIG. 4A, FIG. 4B, and FIG. 4C each illustrate the first intertwined portions formed in a row along the A-A line and the second intertwined portions formed in a row along the B-B line in FIG. 3A, excluding the first intertwined portions and the second intertwined portions formed in rows in other parts.

An angle α formed by the virtual straight line L1 and one virtual straight line L2 and an angle β formed by the virtual straight line L1 and one virtual straight line L3 herein are corresponding angles in the side perspective view of the mat of the embodiment (see FIG. 4A and FIG. 4B).

As illustrated in FIG. 4A and FIG. 4B, the mat 1 is not deformed and has a substantially rectangular shape when no shearing force is applied to the mat 1.

If shearing forces are applied to the mat 1 in directions parallel to the first main face 10*a* and the second main face 10*b* as illustrated in FIG. 4C (in FIG. 4C, arrows C indicate the directions of shearing force application), the mat 1 containing inorganic fibrous substances intertwined with each other and being comparatively flexible tends to be deformed from the substantially rectangular shape into a substantial parallelogram shape.

In the deformation, a tensile force (in FIG. 4C, arrows D indicate the direction of tensile force application) pulling the mat 1 from the inside to the outside is applied to the mat 1 in the direction of the diagonal line connecting two acute angles of the parallelogram. Meanwhile, a compressive force (in FIG. 4C, arrows E indicate the direction of compressive force application) compressing the mat 1 from the outside to the inside is applied to the mat 1 in the direction of the diagonal line connecting two obtuse angles of the parallelogram.

The mat 1, however, tends to minimize the deformation thereof even when shearing forces are applied thereto in directions parallel to the first main face 10*a* and the second main face 10*b* because the first intertwined portions 31 and the second intertwined portions 32 intersect with each other to function as bracing. That is, the virtual straight lines L2 drawn along the first intertwined portions 31, including inorganic fibrous substances closely intertwined with each other and thus having high mechanical strength, are inclined to intersect with the virtual straight line L1 at a predetermined angle α. Similarly, the virtual straight lines L3 drawn along the second intertwined portions 32 also having high mechanical strength are inclined to intersect with the virtual straight line L1 at a predetermined angle β. The virtual straight lines L2 and the virtual straight lines L3 therefore intersect with each other at a predetermined angle γ.

Accordingly, the mat 1 is not easily damaged.

The mat 1 according to the embodiment of the present invention is therefore considered to have sufficiently high shear strength.

In the mat according to the embodiment of the present invention, the angle γ is preferably from about 20° to about 120°. In this case, particularly, the angle α is preferably from about 30° to about 80° and the angle β is preferably from about 100° to about 150°.

This is because such a structure makes it easier to suitably achieve the effect of producing a mat having sufficiently high shear strength.

In the mat according to the embodiment of the present invention, the angle γ is more preferably from about 60° to about 90°. In this case, particularly, the angle α is preferably from about 45° to about 60° and the angle β is preferably from about 120° to about 135°.

This is because such a structure makes it easier to more suitably achieve the effect of producing a mat having sufficiently high shear strength.

In the mat according to the embodiment of the present invention, first rows each are preferably formed by a set of the first intertwined portions aligned at predetermined intervals, and second rows each are preferably formed by a set of the second intertwined portions aligned at predetermined intervals.

In this case, the first rows and the second rows of the mat according to the embodiment of the present invention are preferably alternately formed.

More preferably, the first rows and the second rows are alternately formed at predetermined intervals in a direction parallel to a length direction or width direction of the mat.

Those mats have the first intertwined portions and the second intertwined portions arranged in a good balance in the entire mat without parts in which only the first intertwined portions or second intertwined portions are concentrated. Such a structure makes it easier to more suitably achieve the effect of providing sufficiently high shear strength.

Particularly in the case that the first rows and the second rows are alternately formed at predetermined intervals in a direction parallel to the length direction or width direction of the mat, the shear strength of the mat tends to be further increased.

In the mat according to the embodiment of the present invention, the inorganic fibrous substances are at least one inorganic fibrous material selected from the group consisting of fibrous alumina, fibrous alumina-silica, fibrous silica, biosoluble fibrous matter, and fibrous glass.

Since those inorganic fibrous substances are excellent in characteristics such as heat resistance, mats containing such inorganic fibrous substances and holding sealing materials including such a mat tend to have excellent heat resistance and holding force.

Also, even if the inorganic fibrous substances are scattered in handling of the mat and taken into the human body, the inorganic fibrous substances are easily dissolved and discharged out of the body in the case that the inorganic fibrous substances constituting the mat are a biosoluble fibrous matter. In this case, accordingly, the mat tends to be very safe to the human body.

The mat according to the embodiment of the present invention preferably further comprises an organic binder.

If such a mat including an organic binder is exposed to high temperatures, the organic binder is decomposed to debond the inorganic fibrous substances, which tends to lead to expansion of the mat.

Hence, in the case that an exhaust gas purifying apparatus comprises a holding sealing material comprising an organic binder-containing mat, the organic binder tends to be decomposed by high-temperature exhaust gas and the inorganic fibrous substances tend to be debonded so that the holding sealing material tends to expand when the exhaust gas purifying apparatus is used. Thus, such a holding sealing material tends to provide high holding force.

The mat according to the embodiment of the present invention preferably further includes an expandable material.

A mat containing an expandable material tends to expand when exposed to high temperatures.

In the case that an exhaust gas purifying apparatus comprises a holding sealing material comprising an expandable material-containing mat, the expandable material tends to expand due to high-temperature exhaust gas when the exhaust gas purifying apparatus is used. Thus, the holding sealing material tends to provide high holding force.

The holding sealing material according to the embodiment of the present invention is a holding sealing material for holding an exhaust gas treating body in a casing, the holding sealing material including the mat according to any one of the embodiments of the present invention.

The method for producing a mat according to the embodiment of the present invention is a method for producing a mat, including a needling step of producing a needled sheet, and a firing step of firing the needled sheet, the needling step including preparing a sheet that includes at least a first main face, a second main face opposite to the first main face, a first side face, and a second side face opposite to the first side face, and contains inorganic fibrous substance precursors intertwined with each other, the precursors being converted into inorganic fibrous substances by firing;

piercing the sheet with first needles in such a manner that the first needles intersect with a virtual straight line L1, drawn in a direction perpendicular to a thickness direction of the sheet, at an angle $\alpha$ of less than about 90° in a perspective view of the sheet from the first side face to the second side face, whereby first intertwined portion precursors are formed in the sheet; and piercing the sheet with second needles in such a manner that the second needles intersect with the virtual straight line L1 at an angle $\beta$ of more than about 90° and intersect with virtual straight lines L2, drawn along the first intertwined portion precursors, at a predetermined angle $\gamma$, whereby second intertwined portion precursors are formed in the sheet.

The method for producing a mat according to the embodiment of the present invention makes it easier to suitably produce the mat of the present invention which has sufficiently high shear strength.

The exhaust gas purifying apparatus according to the embodiment of the present invention is an exhaust gas purifying apparatus, including:

an exhaust gas treating body;

a casing which accommodates the exhaust gas treating body; and a holding sealing material which is disposed between the exhaust gas treating body and the casing and holds the exhaust gas treating body, the holding sealing material including the mat according to any one of the embodiments of the present invention or a mat produced by the method for producing a mat according to the present invention.

First Embodiment

The following will describe the first embodiment, which is one embodiment of the mat, holding sealing material, method for producing a mat, and exhaust gas purifying apparatus according to the present invention, referring to the drawings.

The mat of the present embodiment will be described below refer to FIG. 3A and FIG. 3B.

Further, the same matters as those mentioned in the description of the mat according to the embodiment of the present invention will be omitted here.

The mat 1 of the present embodiment illustrated in FIG. 3A, FIG. 3B, and FIG. 3C has a substantially rectangular shape in a plan view with a predetermined length (indicated by a double-headed arrow L in FIG. 3A), width (indicated by a double-headed arrow W in FIG. 3A) and thickness (indicated by a double-headed arrow T in FIG. 3A).

The specific size of the mat 1 is not particularly limited, and is about 100 mm to about 100,000 mm in length×about 100 mm to about 1,500 mm in width×about 5 mm to about 30 mm in thickness.

The mat 1 comprises inorganic fibrous substances 13 and 14 intertwined with each other.

The inorganic fibrous substances are preferably at least one inorganic fibrous material selected from the group consisting of fibrous alumina, fibrous alumina-silica, fibrous silica, biosoluble fibrous matter, and fibrous glass.

Fibrous alumina may contain additives such as CaO, MgO, and $ZrO_2$ in addition to alumina.

The weight ratio in fibrous alumina-silica is preferably $Al_2O_3$:$SiO_2$=about 60:about 40 to about 80:about 20, and more preferably $Al_2O_3$:$SiO_2$=about 70:about 30 to about 74:about 26.

If the amount of alumina in the fibrous alumina-silica is larger than the preferable maximum amount ($Al_2O_3$:$SiO_2$=about 80:about 20), then alumina-silica is easily crystallized and tends to decrease the flexibility of the inorganic fibrous substances to be provided. In contrast, if the amount of silica in the fibrous alumina-silica is smaller than the preferable minimum amount ($Al_2O_3$:$SiO_2$=about 80:about 20), the rigidity of the inorganic fibrous substances to be provided tends to be insufficient, which leads to insufficient shear strength.

Fibrous silica may contain additives such as CaO, MgO, and $ZrO_2$ in addition to silica.

The biosoluble fibrous matter is an inorganic fibrous substance which is at least one compound selected from the group consisting of alkaline metal compounds, alkaline earth metal compounds, and boron compounds.

Since the biosoluble fibrous matter is easily dissolved even if it is taken into the human body, a mat including the biosoluble fibrous substances intertwined with each other is very safe to the human body.

Specific examples of the composition of the biosoluble fibrous matter include one consisting of from about 60% by weight to about 85% by weight of silica, and from about 15% by weight to about 40% by weight of at least one compound selected from the group consisting of alkaline metal compounds, alkaline earth metal compounds, and boron compounds.

The above silica is SiO or $SiO_2$.

Examples of the alkaline metal compounds include oxides of Na and K. Examples of the alkaline earth metal compounds include oxides of Mg, Ca, and Ba. Examples of the boron compounds include oxides of B.

If the amount of silica is about 60% by weight or more, the biosoluble fibrous matter may be easily produced by a glass melting method and also may be easily fibrillated. In this case, the biosoluble fibrous matter tends to be not structurally weak and not dissolved in a physiological saline excessively easily.

On the other hand, an amount of silica of about 85% by weight or less makes it excessively difficult for the resulting biosoluble fibrous matter to be not dissolved in a physiological saline.

The amount of silica is calculated as an $SiO_2$ equivalent value.

Meanwhile, if the amount of the at least one compound selected from the group consisting of alkaline metal compounds, alkaline earth metal compounds, and boron compounds is about 15% by weight or more, it does not tend to be excessively difficult for the resulting biosoluble fibrous matter to be dissolved in a physiological saline.

On the other hand, if the amount thereof about 40% by weight or less, a biosoluble fibrous matter may be easily produced by a glass melting method and also may be easily fibrillated. In this case, the biosoluble fibrous matter tends to be not structurally weak and not dissolved in a physiological saline excessively easily.

The solubility of the inorganic fibrous substance in the physiological saline is preferably about 30 ppm or higher. If the solubility is about 30 ppm or more, the inorganic fibrous substances taken into the human body are easily taken out of the body, which is preferable for the health.

The solubility can be measured by the following method.

(I) First, 2.5 g of an inorganic fibrous substance is suspended in distilled water by a blender for foods, and the solution is allowed to stand such that the inorganic fibrous substance is precipitated. The supernatant is then removed through decantation, and the precipitate is dried at 110° C. to remove the residual liquid. Thereby, an inorganic fibrous substance sample is prepared.

(II) An amount of 6.780 g of sodium chloride, 0.540 g of ammonium chloride, 2.270 g of sodium hydrogen carbonate, 0.170 g of disodium hydrogen phosphate, 0.060 g of sodium citrate dihydrate, 0.450 g of glycine, and 0.050 g of sulfuric acid (specific gravity 1.84) are diluted with distilled water to 1 L, so that a physiological saline solution is prepared.

(III) A centrifugal tube is charged with 0.50 g of the inorganic fibrous substance sample prepared in (I) and 25 $cm^3$ of the physiological saline solution prepared in (II), and is then shaken well. Thereafter, the tube is treated in a shaking incubator at 37° C. and 20 cycles/min for five hours.

The centrifugal tube is taken out, and centrifuged for five minutes at 4,500 rpm. The resulting supernatant is extracted with a syringe.

(IV) Next, the supernatant is filtered with a filter (0.45 μm cellulose nitrate membrane filter). The sample obtained therefrom is subjected to atomic absorption spectrophotometry to determine the solubility of silica, calcium oxide, and magnesium oxide in a physiological saline solution.

The inorganic fibrous substances 13 and 14 preferably have an average fiber length of about 3.5 mm or longer and about 100 mm or shorter. This is because the shear strength of the mat tends to be sufficiently high.

If the average fiber length of the inorganic fibrous substances is about 3.5 mm or longer, the fiber length of the inorganic fibrous substances is not so short that the shear strength of the mat to be produced does not tend to be low.

In contrast, if the average fiber length of the inorganic fibrous substances is about 100 mm or shorter, the fiber length of the inorganic fibrous substances is not so long that the handling property of the inorganic fibrous substances in production of a mat does not tend to be low.

The average fiber diameter of the inorganic fibrous substances 13 and 14 is preferably from about 3 μm to about 10 μm.

If the average fiber diameter of the inorganic fibrous substances 13 and 14 is from about 3 μm to about 10 μm, the strength and flexibility of the inorganic fibrous substances 13 and 14 are sufficiently high, which tends to lead to an increase in the shear strength of the mat 1.

The mat 1 of the present embodiment has four first needle piercing points 21*a* (second needle piercing points 21*b*) aligned at predetermined intervals on the first main face 10*a* (the second main face 10*b*) in the width direction W, whereby one first row 41 is formed.

The mat 1 of the present embodiment also has four third needle piercing points 22*a* (fourth needle piercing points 22*b*) aligned at predetermined intervals on the first main face 10*a* (the second main face 10*b*) in the width direction W, whereby one second row 42 is formed.

Those first rows 41 and second rows 42 are alternately formed at predetermined intervals in the length direction L.

The detailed structures of the first intertwined portions 31 and the second intertwined portions 32 are substantially the same as those in the mat of the embodiment illustrated in FIG. 3B, FIG. 3C, and FIG. 4A.

The first intertwined portions 31 and the second intertwined portions 32 comprise the inorganic fibrous substances 14 which are intertwined with each other more closely than in the non-formation region 33.

Preferably, in a perspective view of the mat 1 of the present embodiment from the first short side face 12*a* to the second short side face 12*b* as illustrated in FIG. 4A, the virtual straight line L1 and the virtual straight lines L2 intersect with each other at an angle α of from about 30° to about 80°, and the virtual straight line L1 and the virtual straight lines L3 intersect with each other at an angle β of from about 100° to about 150°. Here, the virtual straight lines L2 and the virtual straight lines L3 preferably intersect with each other at the angle γ of from about 20° to about 120°.

The above angle α is more preferably from about 45° to about 60°, the angle β is more preferably from about 120° to about 135°, and the angle γ is more preferably from about 60° to about 90°.

The first intertwined portions 31 and the second intertwined portions 32 in the mat 1 of the present embodiment (hereinafter, the term intertwined portion encompasses the first intertwined portion and the second intertwined portion) are preferably formed at a total formation density of from about 0.5 portions/$cm^2$ to about 30 portions/$cm^2$. This is because such a formation density makes the mat 1 easier to have higher shear strength and an appropriately low height.

If the formation density of the intertwined portions is about 0.5 portions/$cm^2$ or more, the number of the intertwined portions formed per unit area is not so small that the shear strength of the mat is less likely to be low and the height thereof is likely to be low.

If the formation density of the intertwined portions is about 30 portions/$cm^2$ or lower, the number of the intertwined portions formed per unit area is not so large that the height of the mat is less likely to be low, and thus the repulsive force is less likely to be low. Further, a large amount of inorganic fibrous substances finely cut by the needling is not contained in the mat, which is likely to lower the shear strength of the mat.

The term "formation density" of the intertwined portions herein means the number of intertwined portions formed per about 1 $cm^2$ in a main cross section which is determined as follows: the mat is divided into two substantially equal parts at the middle point of the mat in the thickness direction along the plane substantially parallel to the first main face and the second main face, and the main cross section obtained thereby is observed and the number is counted visually or with a magnifying glass.

In the mat 1 of the present embodiment, the shortest distance (distance indicated by a double-headed arrow Y in FIG. 3A) between one first needle piercing point 21*a*, second needle piercing point 21*b*, third needle piercing point 22*a*, or fourth needle piercing point 22*b* (hereinafter, each of the first needle piercing point, the second needle piercing point, the third needle piercing point, and the fourth needle piercing point is also referred to simply as a needle piercing point without distinction) and another needle piercing point which is nearest to the one needle piercing point is preferably from about 1 mm to about 10 mm. Such a structure prevents concentrated formation of the intertwined portions, is likely to make the shear strength of the mat sufficiently high, and is likely to make the height of the mat appropriately low.

If the shortest distance between one needle piercing point and another needle piercing point which is nearest to the one needle piercing point is about 10 mm or shorter, the number of the intertwined portions formed per unit area is not so small that the shear strength of the mat is less likely to be low, and the height thereof is likely to be low.

If the shortest distance is about 1 mm or longer, the number of the intertwined portions formed per unit area is not so large that the height of the mat is less likely to be low, and thus the repulsive force is less likely to be low. Further, a large amount of inorganic fibrous substances finely cut by the needling is not contained in the mat, which is less likely to lower the shear strength of the mat.

Each needle piercing point of the mat 1 of the present embodiment preferably has a diameter of from about 0.1 mm to about 2 mm.

Since a diameter of each needle piercing point in the above range is not too large, the shear strength of the mat 1 is likely to be sufficiently high.

A diameter of each needle piercing point of about 2 mm or smaller may be less likely cause the inorganic fibrous substances constituting the needle piercing points and the intertwined points to be in a coarse state. Thus, the shear strength of the mat is less likely to be low.

A diameter of each needle piercing point of about 0.1 mm or larger may cause the inorganic fibrous substances to be sufficiently intertwined with each other in the intertwined portions. Thus, the shear strength of the mat is less likely to be low, and the height of the mat is likely to be sufficiently low.

The weight of the mat 1 (the weight per unit area) of the present embodiment is preferably from about 500 g/m$^2$ to about 3,000 g/m$^2$. This is because a weight of the mat of from about 500 g/m$^2$ to about 3,000 g/m$^2$ tends to allow the first intertwined portions and the second intertwined portions to suitably prevent deformation of the mat, and tends to suitably reduce the height of the mat.

A weight of the mat of about 500 g/m$^2$ or more leads to sufficient prevention of deformation of the mat by the first intertwined portions and the second intertwined portions, and a weight about 3,000 g/m$^2$ or smaller tends to reduce the height of the mat.

The weight of the mat 1 is more preferably from about 1,000 g/m$^2$ to about 2,800 g/m$^2$.

The density of the mat 1 of the present embodiment is preferably from about 0.08 g/cm$^3$ to about 0.20 g/cm$^3$.

This is because a density of the mat of from about 0.08 g/cm$^3$ to about 0.20 g/cm$^3$ tends to cause inorganic fibrous substances to be well intertwined with each other to suppress separation of the inorganic fibrous substances, and tends to render the mat appropriately flexible.

A density of the mat of about 0.08 g/cm$^3$ or more causes the inorganic fibrous substances to be intertwined with each other not to easily separate the inorganic fibrous substances.

A density of a mat of about 0.20 g/cm$^3$ or small is less likely to harden the mat, and is less likely to decrease the handling property.

The density of the mat 1 is more preferably from about 0.10 g/cm$^3$ to about 0.15 g/cm$^3$.

The mat 1 of the present embodiment may contain an organic binder.

In the case that an exhaust gas purifying apparatus comprises a holding sealing material comprising an organic binder-containing mat (hereinafter, also referred to simply as a binder mat), the organic binder tends to be decomposed by high-temperature exhaust gas and the inorganic fibrous substances tend to be debonded so that the holding sealing material tends to expand when such an exhaust gas purifying apparatus is used. Thus, such a holding sealing material tends to provide high holding force.

Examples of the organic binder include water-soluble organic polymers such as acrylic resin, rubbers (e.g. acrylic rubber), carboxymethyl cellulose, and polyvinyl alcohol, thermoplastic resins such as styrene resin, and thermosetting resins such as epoxy resin. Particularly preferable among these are acrylic rubber, acrylonitrile-butadiene rubber, and styrene-butadiene rubber.

The total amount of the organic binder in the binder mat is preferably from about 0.5% by weight to about 20% by weight of the total weight of the binder mat. This is because an organic binder in such an amount more strongly tends to bond the inorganic fibrous substances constituting the binder mat, and thus tends to increase the strength of the binder mat. In addition, an organic binder in such an amount causes the height of the binder mat to be appropriately low.

If the total amount of the organic binder in the binder mat is about 0.5% by weight or more of the total weight of the binder mat, the amount of the organic binder is not so small that the inorganic fibrous substances is less likely to be scattered, and thus the strength of the binder mat is less likely to be low.

If the total amount of the organic binder in the binder mat is about 20% by weight or less of the total weight of the binder mat, the exhaust gas discharged from an exhaust gas purifying apparatus comprising a holding sealing material including the binder mat is less likely to contain a large amount of organic components, which is less likely to damage the environment.

The following will describe the structures of a holding sealing material and an exhaust gas purifying apparatus which comprise the mat of the present embodiment, referring to the drawings.

Figure 5:
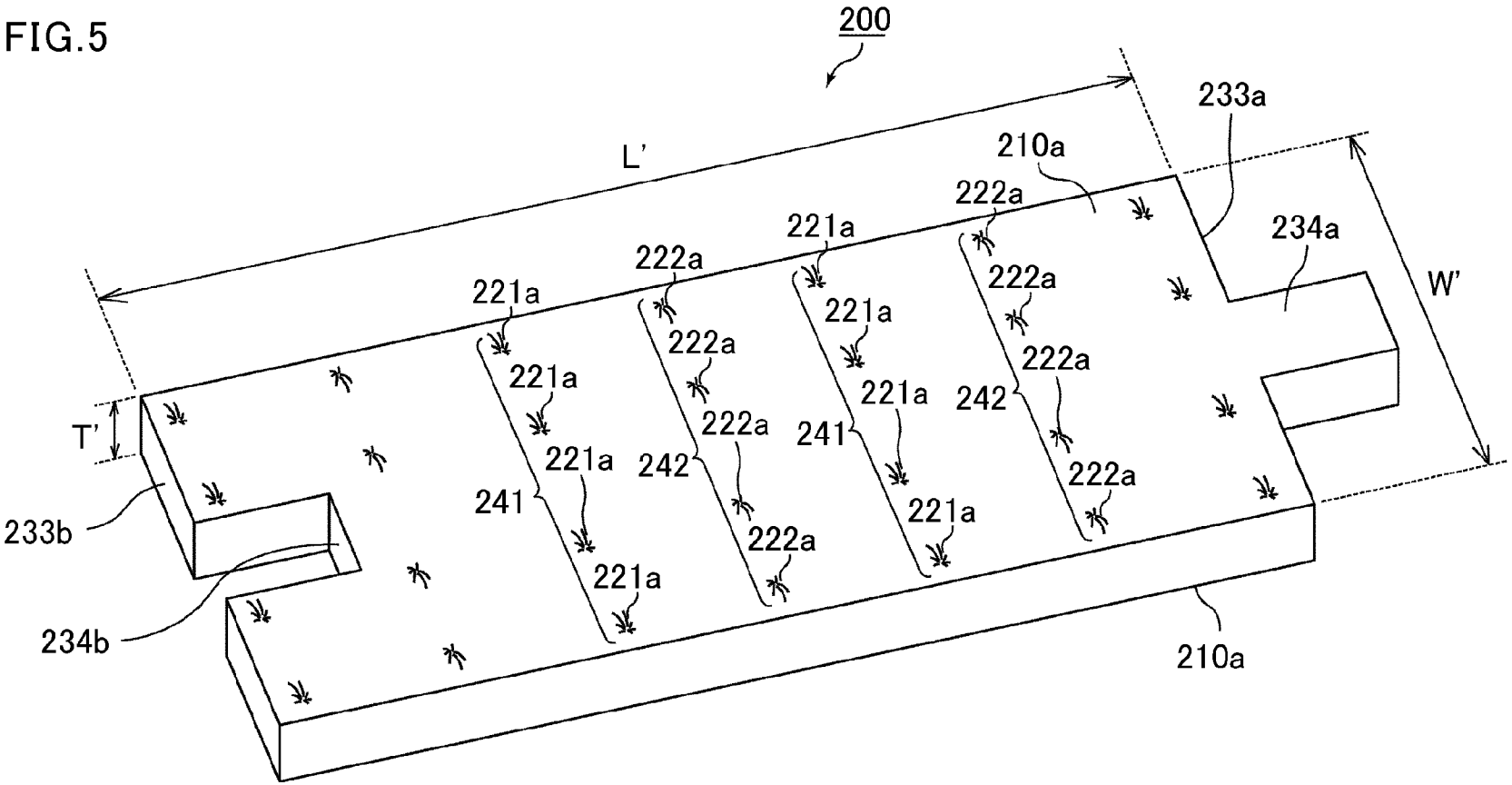
FIG. 5 is a perspective view schematically illustrating one example of a holding sealing material including the mat of a first embodiment of the present invention.

FIG. 5 is a perspective view schematically illustrating one example of a holding sealing material comprising the mat according to the first embodiment of the present invention.

A holding sealing material 200 of the present invention illustrated in FIG. 5 is produced by cutting the mat 1 of the present embodiment into a predetermined shape.

The holding sealing material 200 of the present invention illustrated in FIG. 5 has a substantially rectangular shape in a plan view with a predetermined length (indicated by an arrow L' in FIG. 5), width (indicated by an arrow W' in FIG. 5), and thickness (indicated by an arrow T' in FIG. 5). The length direction, width direction, and thickness direction of the holding sealing material 200 of the present invention illustrated in FIG. 5 respectively correspond to the length direction, width direction, and thickness direction of the mat 1 of the present embodiment illustrated in FIG. 3.

Further, the holding sealing material 200 has end faces 233*a* and 233*b* parallel to each other in the width direction. The end face 233*a* has a protruding portion 234*a*, and the end face 233*b* has a recessed portion 234*b* which fits to the protruding portion 234*a* when the holding sealing material 200 is rolled to bring the end face 233*a* into contact with the end face 233*b*.

The total amount of the organic binder in the holding sealing material 200 of the present embodiment is preferably from about 0.5% by weight to about 20% by weight of the total weight of the holding sealing material.

This is because an organic binder in such an amount more strongly tends to bond the inorganic fibrous substances constituting the holding sealing material 200 of the present embodiment, and thus tends to increase the strength of the holding sealing material 200 of the present embodiment. In addition, an organic binder in such an amount tends to cause the height of the holding sealing material 200 of the present embodiment to be appropriately low.

If the total amount of the organic binder in the holding sealing material is about 0.5% by weight or more of the total weight of the holding sealing material, the amount of the organic binder is not so small that the inorganic fibrous substances are less likely to be scattered, and thus the strength of the holding sealing material is less likely to be low.

If the total amount of the organic binder in the holding sealing material is about 20% by weight or less of the total weight of the holding sealing material, the exhaust gas discharged from an exhaust gas purifying apparatus comprising a holding sealing material including the binder mat is less likely to contain a large amount of organic components, which is less likely to damage the environment.

The holding sealing material 200 preferably has a size of about 200 mm to about 1,000 mm in length×about 50 mm to about 500 mm in width×about 5 mm to about 30 mm in thickness.

The holding sealing material 200 of the present embodiment has the first needle piercing points 221*a* (the second needle piercing points 221*b*) aligned at predetermined intervals on the first main face 210*a* (the second main face 210*b*) in the width direction W', whereby one first row 241 is formed.

The holding sealing material 200 of the present embodiment also has the third needle piercing points 222*a* (the fourth needle piercing points 222*b*) aligned at predetermined intervals in the width direction W', whereby one second row 242 is formed.

Those first rows 241 and second rows 242 in the holding sealing material 200 of the present embodiment are alternately formed at predetermined intervals in the length direction L'.

From the first needle piercing points 221*a* to the respective corresponding second needle piercing points 221*b* in the holding sealing material 200 of the present embodiment, first intertwined portions are continuously formed in the thickness direction T' of the holding sealing material 200.

From the third needle piercing points 222*a* to the respective corresponding fourth needle piercing points 222*b* in the holding sealing material 200 of the present embodiment, second intertwined portions are continuously formed in the thickness direction T' of the holding sealing material 200.

Since the detailed structures of the first intertwined portions and the second intertwined portions of the holding sealing material 200 of the present embodiment have been described above, the description thereof is omitted here.

As illustrated in FIG. 5, the first rows 241 and second rows 242 are preferably alternately formed at predetermined intervals in the length direction L'.

In the case of producing an exhaust gas purifying apparatus through the later-described stuffing step illustrated in FIG. 10, shearing forces are applied in directions parallel to the first main face and the second main face in a side perspective view of the holding sealing material from one short-side side to the other short side face (see FIG. 4C). That is, shearing forces are applied in directions parallel to the width direction W' of the holding sealing material 200.

If the first rows 241 and the second rows 242 are alternately formed at predetermined intervals in the length direction L' in a perspective view of the holding sealing material from one short side face to the other short side face as illustrated in FIG. 4A, the virtual straight line L1 and the virtual straight lines L2 intersect with each other at a predetermined angle $\alpha$, the virtual straight line L1 and the virtual straight lines L3 intersect with each other at a predetermined angle $\beta$, and the virtual straight lines L2 and the virtual straight lines L3 intersect with each other at a predetermined angle $\gamma$.

The first intertwined portions and the second intertwined portions therefore tend to function as bracing, and thus tend to minimize deformation of the holding sealing material 200 to easily prevent the holding sealing material 200 from being damaged even when shearing forces are applied to the holding sealing material 200 in directions parallel to the width direction W'.

This holding sealing material 200 of the present embodiment tends to be suitably used for an exhaust gas purifying apparatus.

The following will describe the structure of the exhaust gas purifying apparatus comprising the holding sealing material 200 of the present embodiment, referring to the drawings.

Figure 6A:
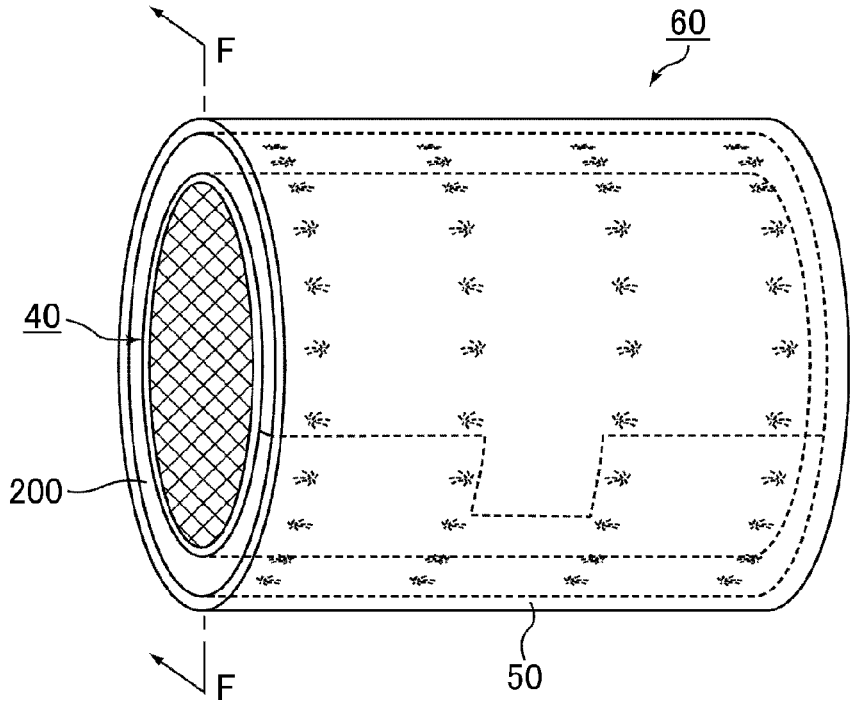
FIG. 6A is a perspective view schematically illustrating an exhaust gas purifying apparatus of the first embodiment of the present invention.
Figure 6B:
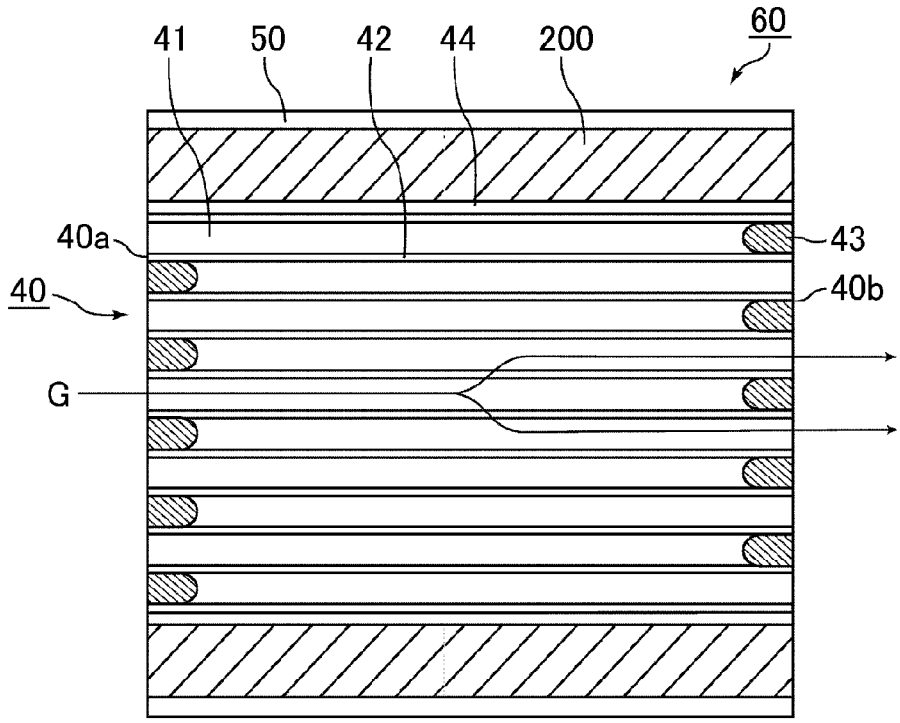
FIG. 6B is an F-F line cross-sectional view of the exhaust gas purifying apparatus of the first embodiment of the present invention illustrated in FIG. 6A.

FIG. 6A is a perspective view schematically illustrating an exhaust gas purifying apparatus according to the first embodiment of the present invention; and FIG. 6B is an F-F line cross-sectional view of the exhaust gas purifying apparatus according to the first embodiment of the present invention illustrated in FIG. 6A.

Figure 7A:
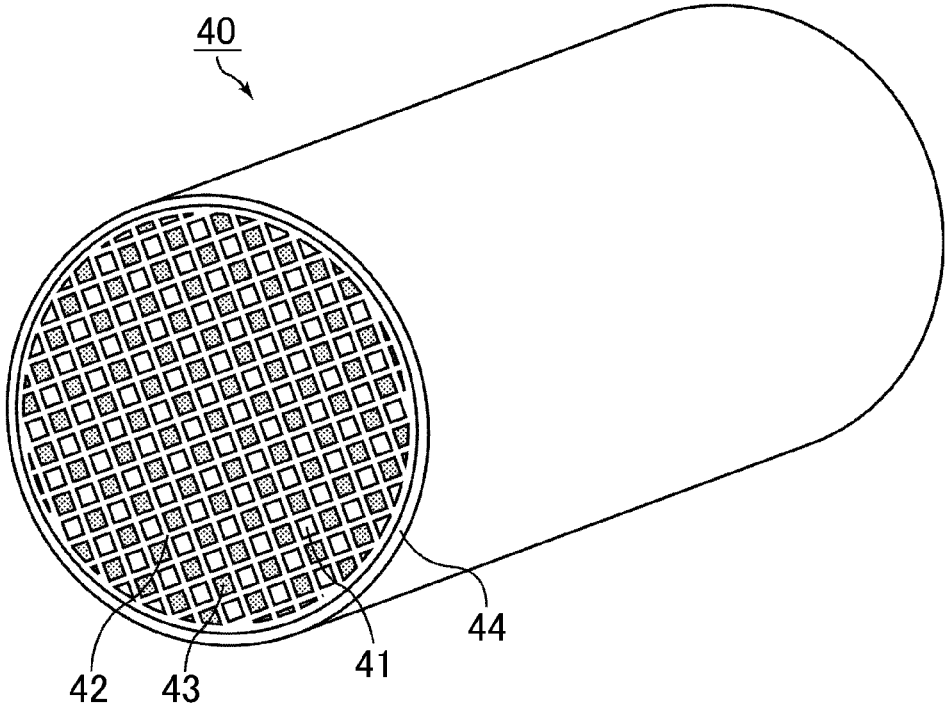
FIG. 7A is a perspective view schematically illustrating an exhaust gas treating body constituting the exhaust gas purifying apparatus of the first embodiment of the present invention illustrated in FIG. 6A.
Figure 7B:
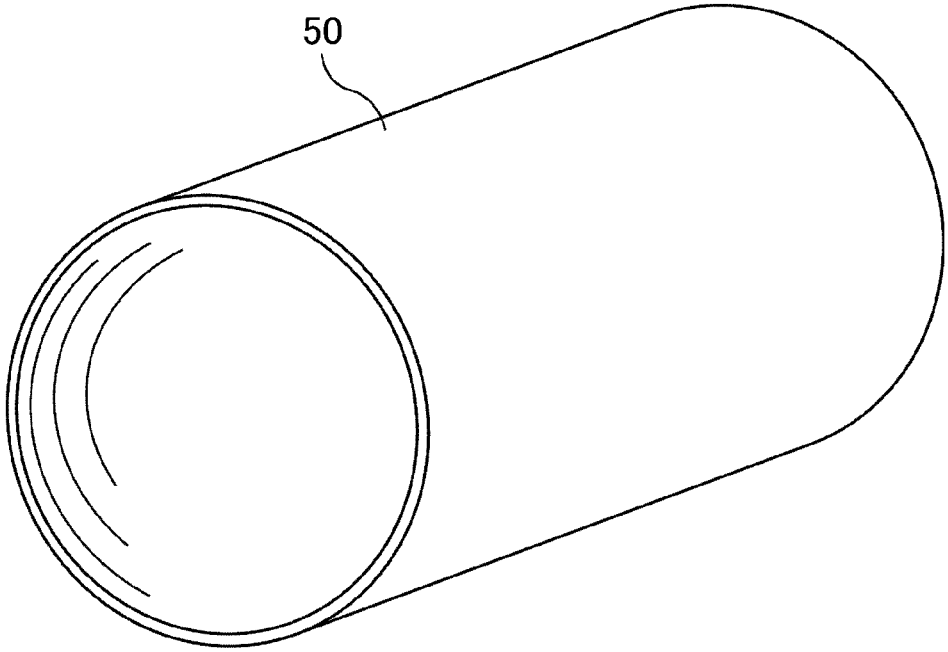
FIG. 7B is a perspective view schematically illustrating a casing constituting the exhaust gas purifying apparatus of the first embodiment of the present invention illustrated in FIG. 6A.

FIG. 7A is a perspective view schematically illustrating an exhaust gas treating body constituting the exhaust gas purifying apparatus according to the first embodiment of the present invention illustrated in FIG. 6A; and FIG. 7B is a perspective view schematically illustrating the casing constituting the exhaust gas purifying apparatus according to the first embodiment of the present invention illustrated in FIG. 6A.

As illustrated in FIG. 6A and FIG. 6B, an exhaust gas purifying apparatus 60 according to the first embodiment of the present invention comprises: a pillar-shaped exhaust gas treating body 40 having cell walls 42 which are disposed in the longitudinal direction and which define a large number of cells 41; a casing 50 which accommodates the exhaust gas treating body 40; and a holding sealing material 200 of the present embodiment, which is disposed between the exhaust gas treating body 40 and the casing 50, and which holds the exhaust gas treating body 40.

The structure of the holding sealing material 200 of the present embodiment has been already mentioned, and thus the description thereof is omitted here.

Further, an introduction pipe for introducing exhaust gas discharged from an internal combustion engine into the exhaust gas purifying apparatus and a discharging pipe for discharging the exhaust gas passing through the exhaust gas purifying apparatus are optionally connected to the ends of the casing 50.

As illustrated in FIG. 7A, the exhaust gas treating body 40 mainly comprises porous ceramic, and has a substantially cylindrical shape. Further, a coating layer 44 is disposed on the periphery of the exhaust gas treating body 40 for the purpose of reinforcing the peripheral portion of the exhaust gas treating body 40, adjusting the shape, and increasing the heat resistance of the exhaust gas treating body 40.

Furthermore, either one end of each of the cells in the exhaust gas treating body 40 is sealed with a plug 43.

The exhaust gas treating body 40 may comprise a material such as cordierite or aluminum titanate and, as illustrated in FIG. 7A, it may be formed in an integrated manner. Alternatively, the exhaust gas treating body may comprise a material such as silicon carbide or silicon-containing silicon carbide and may be formed by binding multiple pillar-shaped honeycomb fired bodies each having cell walls which are disposed in the longitudinal direction and which define a large number of cells via adhesive layers mainly comprising ceramic.

The following will describe the casing 50. The casing 50 illustrated in FIG. 7B mainly comprises a metal such as stainless steel, and has a substantially cylindrical shape. The inner diameter thereof is slightly shorter than the diameter of a wrapped member prepared by wrapping the holding sealing material 200 around the exhaust gas treating body 40. The length thereof is substantially the same as that of the exhaust gas treating body 40 in the longitudinal direction.

The material of the casing is not limited to stainless steel as long as it is a heat-resistant metal. Examples thereof include metals such as aluminum and iron.

The casing may be a casing prepared by dividing a substantially cylindrical casing into multiple casing pieces in the longitudinal direction (that is, a clamshell), a C-profile or U-profile cylindrical casing having a single slit (opening) extending in the longitudinal direction, or a metal plate which is to be tightly wound around a holding sealing material wrapped around an exhaust gas treating body to form a substantially cylindrical casing.

The following will describe the reason that the exhaust gas purifying apparatus 60 of the present embodiment having the above structure purifies exhaust gas, referring to FIG. 6B.

As illustrated in FIG. 6B, exhaust gas discharged from an internal combustion engine and introduced into the exhaust gas purifying apparatus 60 (exhaust gas is indicated by G and the flow of the exhaust gas is indicated by an arrow in FIG. 6B) flows into a first cell 41 having an opening on the end face 40*a* on the exhaust gas inlet side of the exhaust gas treating body 40, and passes through a cell wall 42 which defines the first cell 41. At this time, particulate matter (hereinafter, also referred to simply as PM) in the exhaust gas is captured by the cell wall 42, and thereby the exhaust gas is purified. The purified exhaust gas is discharged from a second cell 41 having an opening on the end face 40*b* on the exhaust gas outlet side, and the gas is finally discharged outside the apparatus.

The following will describe a method for producing the mat of the present embodiment, a method for producing a holding sealing material comprising the produced mat, and a method for producing an exhaust gas purifying apparatus comprising the produced holding sealing material.

The mat of the present embodiment is produced through the following steps (1) to (4).

The following will describe the case of producing a mat comprising fibrous alumina-silica; however, the inorganic fibrous substances constituting the mat of the present embodiment is not limited to fibrous alumina-silica, and may be the aforementioned inorganic fibrous substances comprising various inorganic fibrous materials such as fibrous alumina.

(1) Spinning Step

A basic aluminum chloride aqueous solution is prepared so that the Al content and the atomic ratio between Al and Cl are predetermined values. Silica sol is added into the aqueous solution so that the ratio in the inorganic fibrous substance after the firing is $Al_2O_3$:$SiO_2$=about 60: about 40 to about 80:about 20 (weight ratio), for example. Further, an appropriate amount of an organic polymer for increasing moldability is added thereto to prepare a liquid mixture.

The obtained liquid mixture is concentrated to be a spinning mixture. This spinning mixture is spun by a blowing method, thereby providing an inorganic fibrous substance precursor having a predetermined average fiber diameter.

The blowing method is a method of spinning an inorganic fibrous substance precursor by supplying the spinning mixture extruded from a nozzle for supplying the spinning mixture into the rapid gas stream (air stream) blowing from an air nozzle.

(2) Laying Step

Next, the inorganic fibrous substance precursor is formed into layers by the cross-layer method to produce a sheet having a predetermined size.

The cross-layer method employs a laying apparatus provided with a belt conveyer driven in a certain direction, and an arm that can move back and forth above the belt conveyer in a direction perpendicular to the driving direction of the belt conveyer and supplies the inorganic fibrous substance precursor (precursor web) collected in the form of a thin layer.

To produce a sheet by the cross-layer method with the above laying apparatus, the belt conveyer is first driven. While the belt conveyer is driven, the arm moves back and forth in a direction perpendicular to the driving direction of the belt conveyer to continuously supply the precursor web onto the belt conveyer. The precursor web is thereby laid on the belt conveyer in layers as if a sheet is folded multiple times while the belt conveyer carrying the precursor web is continuously moved in a certain direction. The layers of the precursor web are cut when the length thereof reaches an appropriate length suitable for handling, so that a sheet having a predetermined size is produced.

Such a sheet produced by the cross-layer method has the most parts of the inorganic fibrous substance precursor aligned in a direction substantially parallel to the first main face and the second main face and loosely intertwined with each other.

(3) Needling Step

Figure 8:
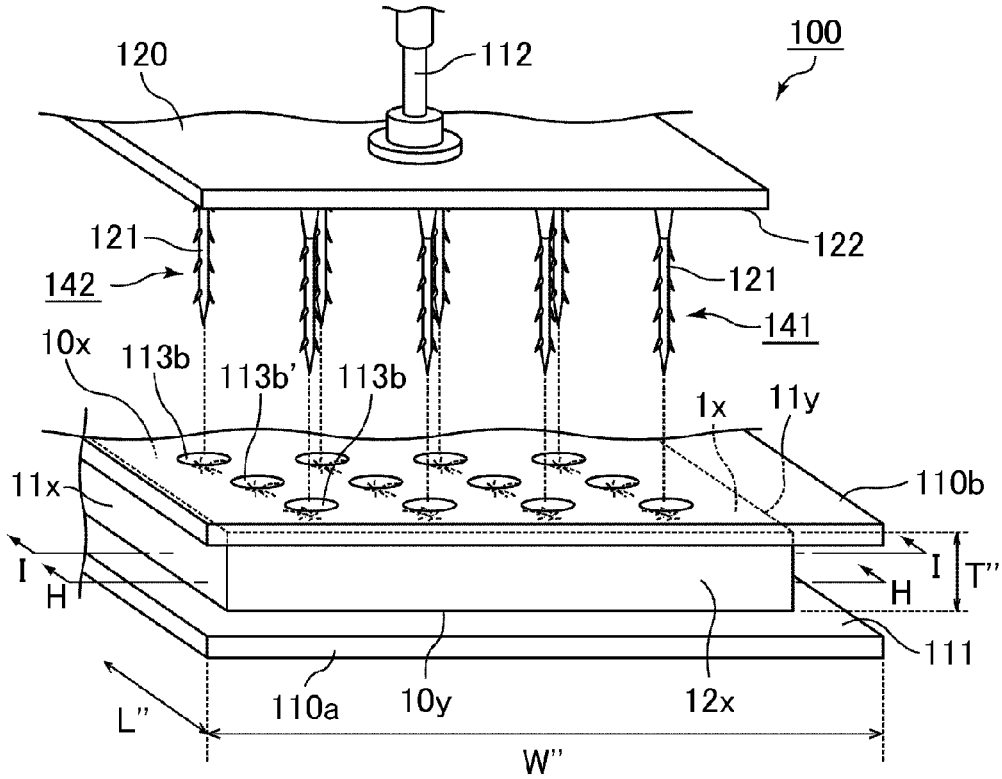
FIG. 8 is a partially cutaway view schematically illustrating a needling apparatus and a sheet which are used in the method for producing a mat according to the embodiment of the present invention.

In the needling step, a needling apparatus illustrated in FIG. 8 is used for needling.

FIG. 8 is a partially cutaway view schematically illustrating a needling apparatus and a sheet which are used in the method for producing a mat according to the present invention.

Figure 9A:
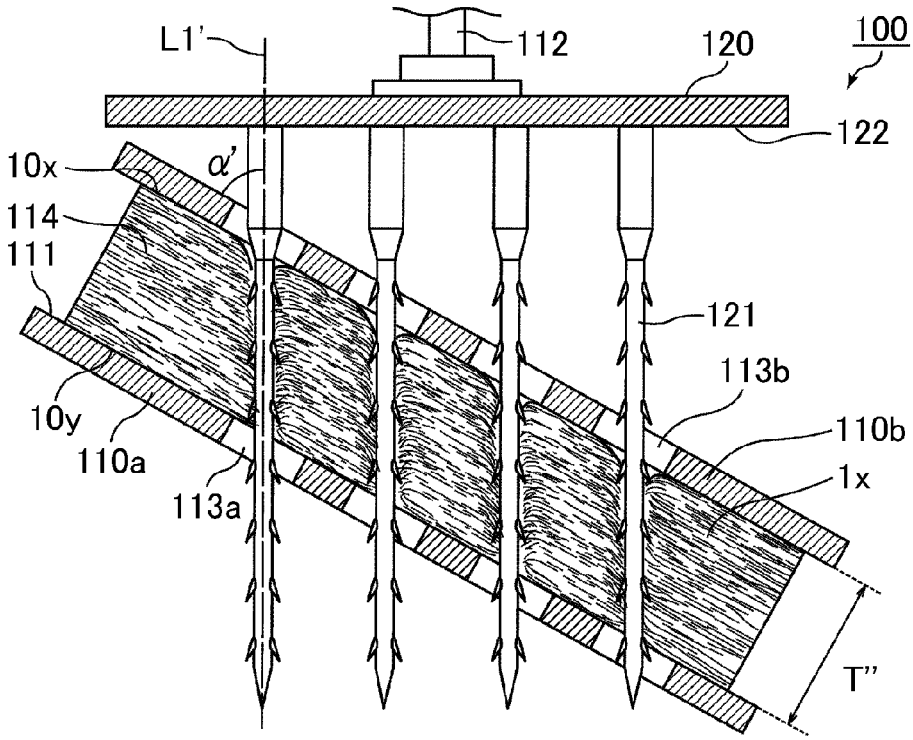
FIG. 9A is an H-H line cross-sectional view of the needling apparatus and the sheet in the first needling in the method for producing a mat according to the embodiment of the present invention.
Figure 9B:
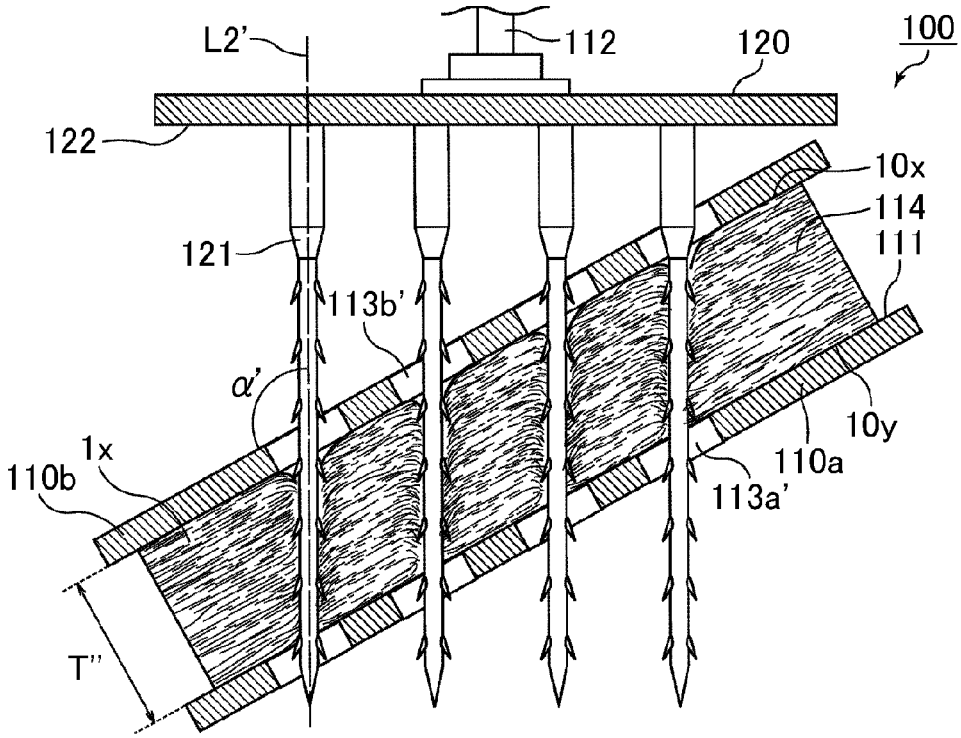
FIG. 9B is an I-I line cross-sectional view of the needling apparatus and the sheet in the second needling in the method for producing a mat according to the embodiment of the present invention.

FIG. 9A is an H-H line cross-sectional view of the needling apparatus and the sheet in the first needling in the method for producing a mat according to the present invention; and FIG. 9B is an I-I line cross-sectional view of the needling apparatus and the sheet in the second needling in the method for producing a mat according to the present invention.

The needling apparatus 100 illustrated in FIG. 8 comprises a supporting plate 110*a* which has a mounting face 111 capable of holding a sheet 1*x*; a pressing plate 110*b* which is arranged opposite to the mounting face 111 and capable of sandwiching the sheet 1*x* with the supporting plate 110*a*; a needle plate 120 which is arranged above the pressing plate 110*b*; and a piston 112 which is attached to the needle plate 120 and is capable of moving up and down in the piercing direction (the thickness direction of the sheet 1*x*, the direction indicated by a double-headed arrow T" in FIG. 8, FIG. 9A and FIG. 9B).

The needle plate 120 is equipped with an opposite face 122 opposite to the pressing plate 110*b*. The opposite face 122 has multiple needles 121 which are disposed at predetermined intervals and extend along the vertical direction, appearing in a pinholder-like shape.

The needles 121 each are finely tapered toward the tip, and are equipped with barbs.

Four of the needles 121 are aligned at predetermined intervals in a width direction W" to form one first needle row 141. Also, another four of the needles 121 are aligned at predetermined intervals in the width direction W" to form one second needle row 142 adjacent to the first needle row 141.

Although the illustration is omitted, those needle rows are continuously formed at predetermined intervals in a length direction L" (the depth direction in FIG. 8).

As illustrated in FIG. 8 and FIG. 9A, the supporting plate 110*a* has multiple openings 113*a* allowing the needles 121 to pierce therethrough, and the pressing plate 110*b* has multiple openings 113*b* allowing the needles 121 to pierce therethrough.

The pressing plate 110*b*, as illustrated in FIG. 8 and FIG. 9B, also has an opening 113*b*' allowing one of the needles 121 to pierce therethrough, at a substantially middle point between one of the openings 113*b* and another of the openings 113*b*.

The supporting plate 110*a* also has an opening 113*a*' allowing one of the needles 121 to pierce therethrough, at a substantially middle point between one of the openings 113*a* and another of the openings 113*a*.

The supporting plate 110*a* and the pressing plate 110*b* are configured to be inclined at predetermined angles.

The sheet 1*x* has a first main face 10*x*, a second main face 10*y* opposite to the first main face 10*x*, a first long side face 11*x*, a second long side face 11*y* opposite to the first long side face 11*x*, a first short side face 12*x*, and a second short side face (not illustrated) opposite to the first short side face 12*x*. The sheet 1*x* includes the inorganic fibrous substance precursors 114 that are intertwined with each other and to be converted into inorganic fibrous substances by firing.

For needling using the above needling apparatus 100, the sheet 1*x* is placed on the mounting face 111 of the supporting plate 110*a* as illustrated in FIG. 8.

Next, the pressing plate 110*b* is placed on the sheet 1*x*.

The sheet 1*x* sandwiched between the supporting plate 110*a* and the pressing plate 110*b* is then inclined to a predetermined angle, together with the supporting plate 110*a* and the pressing plate 110*b*.

More specifically, the supporting plate 110*a*, the pressing plate 110*b*, and the sheet 1*x* are inclined as illustrated in FIG. 9A until the inclination angle α' formed by a straight line L1', drawn in the length direction of the needles 121, and the upper surface of the pressing plate 110*b* reaches a value less than about 90°.

Then, the needle plate 120 is lowered so that the needles 121 are punched into the openings 113*b* of the pressing plate 110*b*.

Thereby, the needles 121 pierce the openings 113*b* of the pressing plate 110*b*, the sheet 1*x*, and the openings 113*a* of the supporting plate 110*a*.

The needles 121 piercing the sheet 1*x* are pulled out of the sheet 1*x*, whereby the first needling is completed.

The first needling allows the needles 121 to pierce the sheet 1*x* in such a manner that the needles 121 intersect with a virtual straight line L1, drawn in a direction perpendicular to the thickness direction of the sheet 1*x*, at an angle α of less than about 90°, in a perspective view of the sheet 1*x* from the first short side face 12*x* to the second short side face.

Thereby, first intertwined portion precursors to be converted into the first intertwined portions by firing are formed.

Next, second needling is performed.

The sheet 1*x* sandwiched between the supporting plate 110*a* and the pressing plate 110*b* is inclined at a predetermined angle, together with the supporting plate 110*a* and the pressing plate 110*b*, in a direction opposite to the direction of the inclination in the first needling.

More specifically, the sheet 1*x* sandwiched between the supporting plate 110*a* and the pressing plate 110*b* is inclined as illustrated in FIG. 9B until the inclination angle α' formed by a straight line L2', drawn in the length direction of the needles 121, and the upper surface of the pressing plate 100*b* reaches a value greater than about 90°.

The supporting plate 110*a*, the pressing plate 110*b*, and the sheet 1*x* are moved to positions that allow the needles 121 to be punched into the openings 113*b*' of the pressing plate 110*b*.

Then, the needle plate 120 is lowered.

Thereby, the needles 121 pierce the openings 113*b*' of the pressing plate 110*b*, the sheet 1*x*, and the openings 113*a*' of the supporting plate 110*a*.

The needles 121 piercing the sheet 1*x* are pulled out of the sheet 1*x*, whereby the second needling is completed.

The second needling allows the needles 121 to pierce the sheet 1*x* in such a manner that the needles 121 intersect with the virtual straight line L1 at an angle β of more than about 90°, and intersect with virtual straight lines L2, drawn along the first intertwined portion precursors, at a predetermined angle γ. Thereby, second intertwined portion precursors to be converted into the second intertwined portions by firing are formed.

These first needling and second needling enable to produce a needled sheet.

Here, the angles α, β, and γ in a mat produced through the later-described steps may be changed to desired values by appropriately changing the inclination angle α' in the first needling or the second needling.

In order to produce a mat in which the formation density of the intertwined portions is from about 0.5 portions/cm$^2$ to about 30 portions/cm$^2$, the minimum distance between one needle piercing point and the nearest needle piercing point thereto is from about 1 mm to about 10 mm, and the diameter of each of the needle piercing points is from about 0.1 mm to about 2 mm, the needle plate used is provided with a predetermined number of needles (needles each having a predetermined diameter) disposed at predetermined intervals per unit area of the opposite face of the needle plate.

Here, the number of times of the needling may be appropriately changed to change the formation density of the intertwined portions.

(4) Firing Step

Thereafter, the needled sheet is fired at a maximum temperature of from about 1,000° C. to about 1,600° C. Thereby, the inorganic fibrous substance precursors are converted into inorganic fibrous substances, so that the mat of the present embodiment is produced.

In the case of producing the holding sealing material of the present embodiment including the mat produced through the step (4), the produced mat may be subjected to the following step (5).

(5) Shaping and Cutting Step

The mat is cut into a predetermined size to provide a holding sealing material.

At this time, the mat is cut such that a protruding portion is formed on part of one end face of the holding sealing material and a recessed portion which has such a shape that fits to the protruding portion is formed on part of the other end face of the holding sealing material.

Specifically, the holding sealing material is produced using a punching apparatus that has: a punching plate which is disposed on the tip of a piston and which is capable of moving up and down; and a mounting plate which is opposite to the punching plate and on which the mat is to be mounted.

The punching plate has fixed thereon a punching blade having a shape corresponding to the outer shape of a holding sealing material to be produced and an elastic member comprising extendable rubber or the like material. Further, the mounting plate has an opening at the position corresponding to the punching blade so that the punching blade does not touch the mounting plate when the punching blade is brought close to the mounting plate.

In the case of punching the mat with such a punching apparatus, the mat is placed on the mounting plate such that the first main face of the mat faces the punching plate and the second main face of the mat faces the mounting plate, and then the punching plate is moved up and down.

The elastic member is pressed to the mat so that it contracts in the thickness direction of the mat, and simultaneously the punching blade enters the mat from the first main face of the mat and the punching blade cuts through the mat.

Thereby, the mat is punched into a predetermined shape illustrated in FIG. 5 and a holding sealing material is produced.

In the case of producing an exhaust gas purifying apparatus comprising the holding sealing material produced through the step (5), the produced holding sealing material may be subjected to the following step (6).

The following will describe the step (6) for producing an exhaust gas purifying apparatus referring to the drawings.

Figure 10:
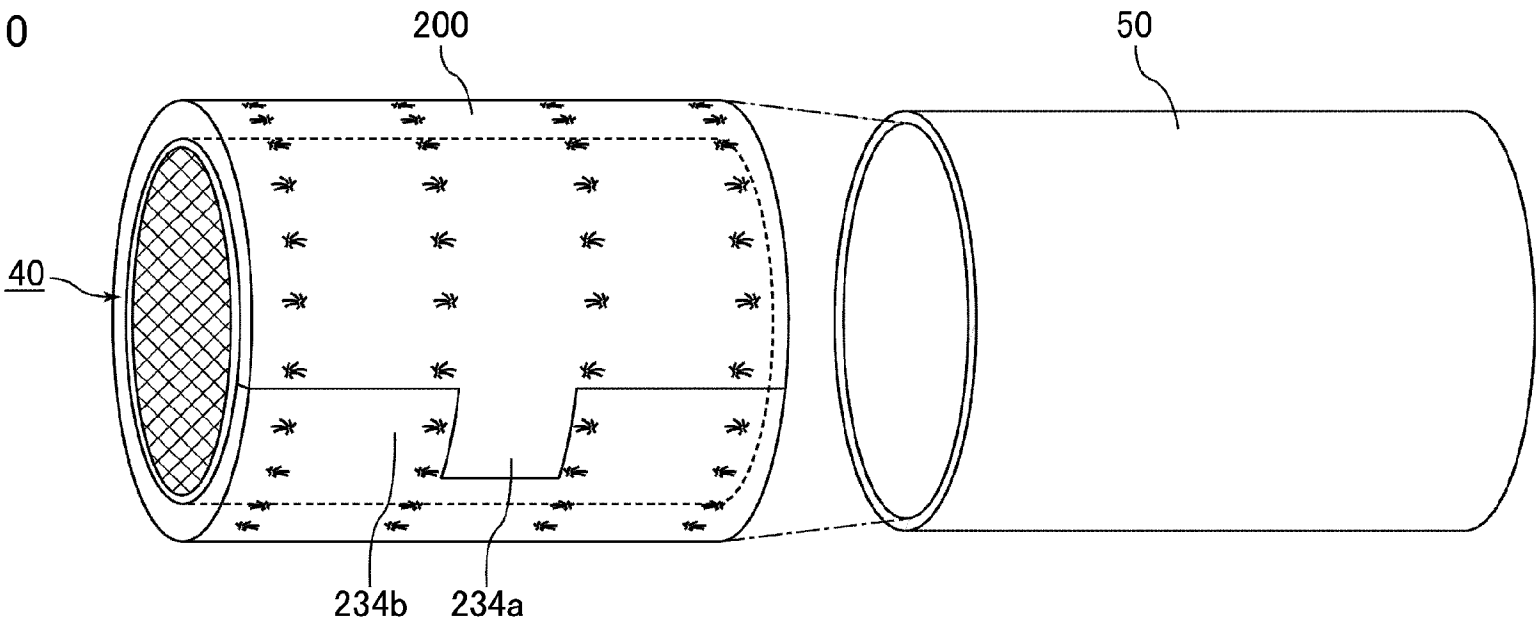
FIG. 10 is a perspective view schematically illustrating production of an exhaust gas purifying apparatus using a holding sealing material, an exhaust gas treating body, and a casing which constitute the exhaust gas purifying apparatus according to the first embodiment of the present invention.

FIG. 10 is a perspective view schematically illustrating production of an exhaust gas purifying apparatus using a holding sealing material, an exhaust gas treating body, and a casing which constitute the exhaust gas purifying apparatus according to the first embodiment of the present invention.

(6) Stuffing Step

The holding sealing material 200 produced in the step (5) is wrapped around the periphery of the cylindrical exhaust gas treating body (honeycomb filter) 40 such that the protruding portion 234*a* and the recessed portion 234*b* fit to each other. Then, as illustrated in FIG. 10, the exhaust gas treating body 40 wrapped with the holding sealing material 200 is stuffed into a cylindrical casing 50 mainly comprising metal and having a predetermined size.

At the time of stuffing, a stuffing jig may be used which has, at one end, an inner diameter slightly smaller than the inner diameter of the end of the casing, and has, at the other end, an inner diameter sufficiently larger than the outer diameter of the exhaust gas treating body including the holding sealing material.

The exhaust gas purifying apparatus 60 of the present embodiment illustrated in FIG. 6A and FIG. 6B is produced through the above step.

The following will list the effects of the mat, the holding sealing material, the method for producing a mat, and the exhaust gas purifying apparatus according to the first embodiment of the present invention.

(1) The mat of the present embodiment has multiple intertwined portions each continuously formed from one first needle piercing point to the corresponding second piercing point in the thickness direction of the mat.

Further, since the inorganic fibrous substances are intertwined with each other at the intertwined portions, the height of the mat tends to be appropriately reduced toward the intertwined portions.

(2) FIG. 4A illustrates the mat of the present embodiment in which the virtual straight line L1 and the virtual straight lines L2 intersect with each other at an angle $\alpha$ of less than about 90°, the virtual straight line L1 and the virtual straight lines L3 intersect with each other at an angle $\beta$ of more than about 90°, and the virtual straight lines L2 and the virtual straight lines L3 intersect with each other at a predetermined angle $\gamma$.

The first intertwined portions and the second intertwined portions therefore tend to function as bracing, and thus tends to minimize deformation of the mat even when shearing forces are applied to the mat in directions parallel to the first main face and the second main face. Accordingly, the mat is not easily damaged.

As above, the mat of the present embodiment tends to have sufficiently high shear strength.

The shear strength tends to be higher in the case that the angle $\gamma$ is from about 20° to about 120°, the angle $\alpha$ is from about 30° to about 80°, and the angle $\beta$ is from about 100° to about 150°.

The shear strength tends to be even higher in the case that the angle $\gamma$ is from about 60° to about 90°, the angle $\alpha$ is from about 45° to about 60°, and the angle $\beta$ is from about 120° to about 135°.

(3) The mat of the present embodiment has the first rows each formed by a set of first intertwined portions aligned at predetermined intervals, and the second rows each formed by a set of second intertwined portions aligned at predetermined intervals.

More specifically, the first rows and the second rows are alternately formed at predetermined intervals in a direction parallel to the length direction or width direction of the mat.

Those mats have the first intertwined portions and the second intertwined portions which tend to be arranged in a good balance in the entire mat without parts in which only the first intertwined portions or second intertwined portions are concentrated. Hence, the mats tend to achieve high shear strength.

(4) The inorganic fibrous substances constituting the mat of the present embodiment are at least one inorganic fibrous material selected from the group consisting of fibrous alumina, fibrous alumina-silica, fibrous silica, biosoluble fibrous matter, and fibrous glass.

Since these inorganic fibrous substances are excellent in characteristics such as heat resistance, the mat of the present embodiment tends to be excellent in characteristics such as heat resistance and holding force.

Also, even if the inorganic fibrous substances are scattered in handling of the mat and taken into the human body, the inorganic fibrous substances are easily dissolved and easily discharged out of the body in the case that the inorganic fibrous substances constituting the mat are a biosoluble fibrous matter. In this case, accordingly, the mat tends to be very safe to the human body.

(5) Since the holding sealing material of the present embodiment includes the above mat of the present embodiment, the height of the holding sealing material tends to be appropriately low. Hence, in the case of using the holding sealing material to produce an exhaust gas purifying apparatus, an exhaust gas treating body wrapped with the holding sealing material is easily stuffed into the casing.

(6) The holding sealing material of the present embodiment has high shear strength because it includes the mat of the present embodiment in which the first intertwined portions and the second intertwined portions functioning as bracing are formed.

Hence, the holding sealing material is not easily damaged when an exhaust gas treating body wrapped with the holding sealing material is stuffed into a casing.

The exhaust gas purifying apparatus produced thereby has the holding sealing material that is not easily damaged and tends to have high durability.

(7) The method for producing a mat according to the present embodiment tends to suitably provide the mat of the present embodiment having the aforementioned structure and showing the aforementioned effects.

(8) Since the exhaust gas purifying apparatus of the present embodiment comprises the exhaust gas treating body having the aforementioned specific structure, it tends to efficiently remove PM and gaseous harmful matter in exhaust gas.

Further, since the holding sealing material constituting the exhaust gas purifying apparatus comprises the mat of the present embodiment which has high shear strength, the holding sealing material is less likely to be damaged when used.

EXAMPLES

Example 1

The mat of the present embodiment was produced through the following steps (1) to (5).

(1) Spinning Step

A basic aluminum chloride aqueous solution was prepared so that the Al content was 70 g/l and Al:Cl=1:1.8 (atomic ratio). Silica sol was added to the solution so that the ratio in the inorganic fibrous substance after the firing was $Al_2O_3$:$SiO_2$=72:28 (weight ratio). Further, an appropriate amount of an organic polymer (polyvinyl alcohol) was added thereto. Thereby, a liquid mixture was prepared.

The obtained liquid mixture was concentrated to be a spinning mixture. This spinning mixture was spun by the blowing method. Thereby, an inorganic fibrous substance precursor was produced.

The inorganic fibrous substance precursor had an average fiber length of 100 mm and an average fiber diameter of 8.0 μm.

(2) Laying Step

The inorganic fibrous substance precursor obtained in the step (1) was formed into layers by the cross-layer method. Thereby, a continuous long sheet with a predetermined size was produced.

(3) Cutting Step

The long sheet was cut into a predetermined size. Thereby, a sheet was produced.

The produced sheet had a substantially rectangular shape in a plan view, a size of 150 mm in length×150 mm in width×12 mm in thickness, and a weight per unit area of 2,420 g/m$^2$.

(4) Needling Step

A needling apparatus having substantially the same structure as the needling apparatus illustrated in FIG. 8 was prepared.

Here, the needle plate was provided with nine needles per unit area (cm$^2$) at predetermined intervals on the opposite face of the needle plate. The needles each were about 2 mm in diameter.

The sheet was placed on the mounting surface in such a manner that the second main face of the sheet came in contact with the mounting surface of the supporting plate.

The sheet was sandwiched by the supporting plate and the pressing plate to the thickness of the sheet of 15 mm.

The supporting plate, the pressing plate, and the sheet were inclined until the inclination angle α' formed by a straight line drawn in the length direction of the needles and the upper surface of the pressing plate reaches 45°.

Then, the needle plate above the supporting plate, the sheet, and the pressing plate was lowered so that the needles pierce the sheet from the first main face to the second main face.

The needles piercing the sheet were pulled out of the sheet, whereby the first needling was completed.

Next, the second needling was performed.

More specifically, the sheet sandwiched by the supporting plate and the pressing plate was inclined until the inclination angle α' formed by a straight line drawn in the length direction of the needles and the upper surface of the pressing plate reached 135°.

The supporting plate, the pressing plate, and the sheet were moved to positions that allowed the needles to be punched into openings on the pressing plate which were different from the openings that the needles pierced in the first needling.

Then, the needle plate above the supporting plate, the sheet, and the pressing plate were lowered so that the needles pierced the sheet from the first main face to the second main face.

The needles piercing the sheet were pulled out of the sheet, whereby the second needling was completed.

The needled sheet was produced through the above step.

(5) Firing Step

The needled sheet was fired at a maximum temperature of 1,250° C. such that the inorganic fibrous substance precursor was converted into an inorganic fibrous substance. Thereby, the mat of the present embodiment was produced.

The produced mat included fibrous alumina-silica intertwined with each other, and had a size of 105 mm in length×105 mm in width×8.4 mm in thickness and a weight per unit area of 2,470 g/m$^2$.

The mat also had the first intertwined portions formed from the first needle piercing points to the second needle piercing points, and the second intertwined portions formed from the third needle piercing points to the fourth needle piercing points.

Approximately, the angle α formed by the virtual straight line L1 and the virtual straight lines L2 was 45°, the angle β formed by the virtual straight line L1 and the virtual straight lines L3 was 135°, and the angle γ formed by the virtual straight lines L2 and the virtual straight lines L3 was 90°.

A sample having a size of 25 mm in length×50 mm in width was produced from the mat, and was divided into two substantially equal parts at the middle point of the sample in the thickness direction along the plane substantially parallel to the first main face and the second main face. The main cross section obtained thereby was observed to determine the total formation density of the first intertwined portions and the second intertwined portions.

The resulting total formation density of the first intertwined portions and the second intertwined portions was 20 portions/cm$^2$.

The shortest distance between one needle piercing point and the nearest needle piercing point thereto was 2.7 mm.

Each needle piercing point had a diameter of 1 mm.

(Shear Strength Measurement Test)

Figure 11:
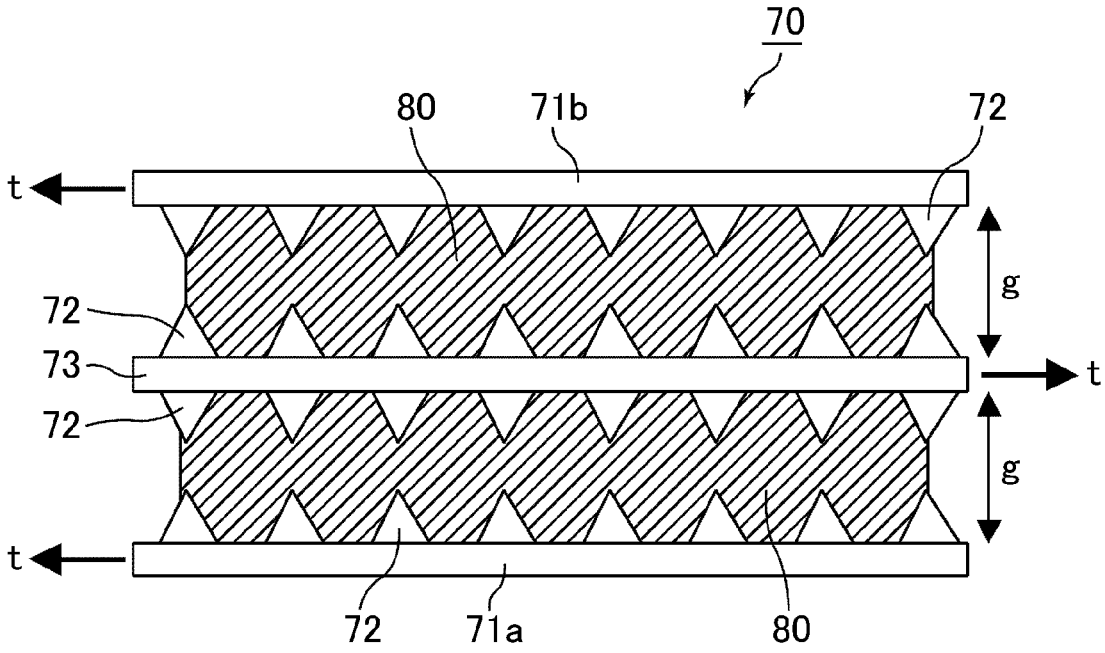
FIG. 11 is a side view schematically illustrating a shear strength testing apparatus.

A shear strength measurement test was performed with a shear strength tester illustrated in FIG. 11.

FIG. 11 is a side view schematically illustrating the shear strength tester.

The shear strength tester 70 illustrated in FIG. 11 comprises two SUS-made plates 71*a* and 71*b* (50 mm in length×50 mm in width×3 mm in thickness) each provided with seventy-seven conical protrusions 72 (1 mm in bottom diameter×1.6 mm in height) on either one main face, and a SUS-made middle plate 73 (50 mm in length×50 mm in width×3 mm in thickness) provided with seventy-seven conical protrusions 72 (1 mm in bottom diameter×1.6 mm in height) on both of the main faces.

The shear strength was measured as follows with the shear strength tester 70.

First, the produced mat was punched into a size of 25 mm in width×50 mm in length in a plan view to provide a sample for shear strength measurement. The width direction of the sample and the width direction of the mat are the same, and the length direction of the sample and the length direction of the mat are the same. Therefore, in a perspective view of the sample from one short side face to the other short side face, the virtual straight lines L2 (first intertwined portions) and the virtual straight lines L3 (second intertwined portions) intersect with each other as illustrated in FIG. 4A.

A first measurement sample 80 was placed on the main face of a plate 71*a* where the protrusions 72 were formed, and the middle plate 73 having the protrusions 72 on the main faces thereof was placed on the sample 80 with a predetermined gap g.

Subsequently, a second measurement sample 80 was placed on the middle plate 73, and a plate 71*b* was placed on the sample 80 with a predetermined gap g.

Thereby, each measurement sample 80 was placed in one of the respective gaps formed between the three plates; that is, the two samples in total were placed between the plates. Then, these samples were compressed.

At this time, the gaps between the three plates were adjusted so that the compressed samples 80 each had a density of 0.35 g/cm$^3$.

Thereafter, the two plates 71*a* and 71*b* and the middle plate 73 were pulled in opposite directions (directions indicated by arrows t in FIG. 11), and the maximum shear stress (N) generated at that time was measured.

The plates were pulled in such a manner to apply shearing forces to the samples in directions parallel to the width direction of the samples.

As a result, the maximum shear strength of the samples was 251.2 N.

Examples 2 to 6, Reference Examples 1 and 2

A mat was produced by the same procedure as that for Example 1, except that the inclination angle α' in the first needling and the second needling at the step (4) of Example 1 was changed to the values listed in the following Table 1.

Comparative Example 1

A mat of Comparative Example 1 was produced by the same procedure as that for Example 1, except that the supporting plate and the pressing plate were not inclined at the step (4) of Example 1 and the inclination angle α' was set to 90° in the first needling and the second needling.

Comparative Examples 2 and 3

A mat of Comparative Example 2 was produced by the same procedure as that for Example 1, except that the inclination angle α' was set to 45° in the first and second needling.

A mat of Comparative Example 3 was produced by the same procedure as that for Example 1, except that the inclination angle α' was set to 60° in the first and second needling.

The minimum distance between one needle piercing point and the nearest needle piercing point thereto in Examples 2 to 6, Reference Examples 1 and 2, and Comparative Examples 1 to 3 was 2.7 mm.

The diameter of each first needle piercing point on the first main face and each second needle piercing point on the second main face in Examples 2 to 6, Reference Examples 1 and 2, and Comparative Examples 1 to 3 was 1 mm.

The shear strength measurement test was performed on the mat produced in each of Examples 2 to 6, Reference Examples 1 and 2, and Comparative Examples 1 to 3 by the same procedure as that for Example 1.

Table 1 shows the primary structures and the results of the shear strength measurement tests in Example 1, Examples 2 to 6, Reference Examples 1 and 2, and Comparative Examples 1 to 3.

TABLE 1

| | Inclination angle (α') in first needling | Inclination angle (α') in second needling | Relation between virtual straight lines L2 and virtual straight lines L3 | Angle (γ) formed by virtual straight lines L2 and virtual straight lines L3 (*1) | Maximum shear stress (N) |
|---|---|---|---|---|---|
| Example 1 | 45° | 135° | Intersected | 90° | 251.2 |
| Example 2 | 60° | 120° | Intersected | 60° | 260.6 |
| Example 3 | 45° | 120° | Intersected | 75° | 255.9 |
| Example 4 | 30° | 150° | Intersected | 120° | 176.4 |
| Example 5 | 80° | 100° | Intersected | 20° | 171.4 |
| Example 6 | 60° | 100° | Intersected | 40° | 216.0 |
| Reference Example 1 | 25° | 155° | Intersected | 130° | 134.8 |
| Reference Example 2 | 85° | 95° | Intersected | 10° | 130.7 |
| Comparative Example 1 | 90° (*2) | | Substantially parallel (not intersected) | N/A | 83.1 |
| Comparative Example 2 | 45° (*3) | 45° (*3) | Substantially parallel (not intersected) | N/A | 122.1 |
| Comparative Example 3 | 60° (*3) | 60° (*3) | Substantially parallel (not intersected) | N/A | 127.0 |

(*1) Estimated value calculated from inclination angle (α') in first needling and inclination angle (α') in second needling.
(*2) Supporting plate and pressing plate were not inclined in first needling and second needling.
(*3) Inclination angle (α') was the same in first needling and second needling.

Table 1 shows that the mats of Examples 1 to 6 and Reference Examples 1 and 2 each had high maximum shear stress (shear strength).

This is probably because the inclination angle α' (angle α formed by the virtual straight line L1 and the virtual straight lines L2) in the first needling was less than 90°, and the inclination angle α' (angle β formed by the virtual straight line L1 and the virtual straight lines L3) in the second needling was more than 90° in the second needling.

Further, the results of Examples 1 to 6 show that the shear strength was higher in the case that the inclination angle α' (angle α) was in the range of 30° to 80°, the inclination angle α' (angle β) in the second needling was in the range of 100° to 150°, or the angle γ formed by the virtual straight lines L2 and the virtual straight lines L3 was 20° to 120°.

Particularly, the shear strength was even higher in the case that the inclination angle α' (angle α) was in the range of 45° to 60°, the inclination angle α' (angle β) in the second needling was in the range of 120° to 135°, or the angle γ was 60° to 90°.

The mat of Comparative Example 1 had very low shear strength probably because it had the first intertwined portions and the second intertwined portions that were perpendicular to the first main face and the second main face of the mat, that is, the first intertwined portions and the second intertwined portions were not inclined.

The mats of Comparative Examples 2 and 3 each had the first intertwined portions and the second intertwined portions inclined to the first main face and the second main face. The first intertwined portions and the second intertwined portions, however, were inclined in the same direction to be substantially parallel to each other, and thus the virtual straight lines L2 and the virtual straight lines L3 did not intersect with each other.

Such a structure probably led to the low shear strength.

Other Embodiments

The mat according to the embodiment of the present invention is merely required to have at least the first main face, the second main face opposite to the first main face, the first side face, and the second side face opposite to the first side face. As long as the mat satisfies the above requirement, the mat may have any shape such as a flat plate shape having a predetermined thickness and showing a substantially square shape in a plan view, other than the flat plate shape having a predetermined thickness and showing a substantially rectangular shape in a plan view.

In a perspective view of the mat according to the embodiment of the present invention from the first side face to the second side face opposite to the first side face, the virtual straight line L1 and the virtual straight lines L2 intersect with each other at an angle $\alpha$ of less than about 90°, the virtual straight line L1 and the virtual straight lines L3 intersect with each other at an angle $\beta$ of more than about 90°, and the virtual straight lines L2 and the virtual straight lines L3 intersect with each other at a predetermined angle $\gamma$.

Here, the first side face may be anyone of the side faces of the mat, and the second side face may be the side face opposite to the first side face.

More specifically, as described above with reference to FIG. 4A in the first embodiment, the above first side face may be the first short side face and the above second side face may be the second short side face, and the virtual straight lines may be in the above specific relations in a side perspective view of the mat from the first short side face to the second short side face.

Alternatively, the above first side face may be the first long side face and the above second side face may be the second long side face, and the virtual straight lines may be in the above specific relations in a side perspective view of the mat from the first long side face to the second long side face. In this perspective view of the mat from the first long side face to the second long side face, the structure is substantially the same as that of the perspective view of the mat according to the first embodiment illustrated in FIG. 4A, except that conditions such as the numbers of the virtual straight line L1, the virtual straight lines L2, the virtual straight lines L3, the angle $\alpha$, the angle $\beta$, and the angle $\gamma$ are different.

Preferably, as described above for the first embodiment of the present invention (see FIG. 3A), the mat according to the embodiment of the present invention has first rows each formed by a set of the first intertwined portions aligned at predetermined angles and second rows each formed by a set of second intertwined portions aligned at predetermined intervals, and has the first rows and the second rows alternately formed.

However, the first rows may be adjacent to each other and the second rows may be adjacent to each other. For example, the first rows and the second rows may be formed from the first short side face to the second short side face in a pattern of the first row, first row, second row, second row, first row, first row, and so forth.

The holding sealing material according to the embodiment of the present invention may also have the first rows adjacent to each other and the second rows adjacent to each other.

Such an embodiment can also achieve the effect of producing a mat and a holding sealing material which have sufficiently high shear strength.

In the mat according to the embodiment of the present invention, the first rows and the second rows may be alternately formed at predetermined intervals in a direction parallel to the width direction of the mat.

Similarly in the holding sealing material according to the embodiment of the present invention, the first rows and the second rows may be alternately formed at predetermined intervals in a direction parallel to the width direction of the mat.

Such an embodiment can also achieve the effect of producing a mat and a holding sealing material which have sufficiently high shear strength.

The mat according to the embodiment of the present invention may be a binder mat as described in the first embodiment of the present invention. A binder mat may be produced through the following steps (A) to (C).

(A) Impregnating Step

First, the organic binder solution containing an organic binder described in the first embodiment of the present invention is prepared.

The whole mat produced through the firing step is uniformly impregnated in the solution by a technique such as flow coating to provide an impregnated mat.

Here, the organic binder solution may be prepared by dissolving the organic binder into a solvent such as water or an organic solvent, or dispersing the organic binder in a dispersion medium such as water.

Preferably, the concentration of the organic binder solution is appropriately adjusted such that the total amount of the organic binder in the binder mat to be produced through the following steps is from about 0.5% by weight to about 20% by weight of the total weight of the binder mat.

(B) Sucking Step

Next, excessive organic binder solution is suction-removed from the impregnated mat with a device such as a suction apparatus.

The sucking step is not necessarily performed. If the impregnated mat contains a small amount of the organic binder solution, for example, the obtained impregnated mat may be subjected to the following drying step directly after the impregnating step.

(C) Drying Step

Thereafter, the solvent and the like in the organic binder solution remaining in the impregnated mat is volatilized with an apparatus such as a heat-air drier while the impregnated mat is compressed.

Thereby, the binder mat is produced.

The mat according to the embodiment of the present invention may further comprise an expandable material.

In the case that an exhaust gas purifying apparatus comprises a holding sealing material comprising an expandable material-containing mat, the expandable material expands due to high-temperature exhaust gas when the exhaust gas purifying apparatus is used. Thus, the mat tends to show high holding force.

Examples of the expandable material include expandable vermiculite, bentonite, and expandable graphite.

The method for producing a mat according to the embodiment of the present invention employs a sheet produced by forming inorganic fibrous substance precursors into layers is used.

However, the sheet may be replaced by a sheet containing inorganic fibrous substances (hereinafter also referred to as an inorganic fibrous sheet). For example, the mat according to the embodiment of the present invention tends to be suitably produced from an inorganic fibrous sheet instead of the sheet used in the needling step (3) in the first embodiment of the present invention.

The inorganic fibrous sheet may be produced by firing the sheet produced by forming into layers the inorganic fibrous substance precursors described in the first embodiment of the present invention.

Alternatively, the inorganic fibrous sheet can also be produced through centrifugation.

In the case of centrifugation, the sheet may be produced as follows. A rotatable cylindrical body having a large number of small holes on the surrounding wall is prepared. This cylindrical body is rotated at high speed while being heated, and a fused material such as fused silica or fused alumina is supplied into the cylindrical body. The fused material supplied is emitted outside the body through the holes due to centrifugal force. The emitted fused material is heated by a burner disposed around the cylindrical body, and thereby extended. The extended fibrous fused material is cooled down to provide an inorganic fibrous substance.

The produced inorganic fibrous substance is compressed, and thereby the sheet comprising the inorganic fibrous substance is produced.

The inorganic fibrous substance constituting the inorganic fibrous sheet may be an inorganic fibrous substance having the same structures (e.g. type, composition, average fiber length, and average fiber diameter) as the aforementioned inorganic fibrous substances constituting the mat according to the embodiment of the present invention.

The exhaust gas treating body constituting the exhaust gas purifying apparatus according to the embodiment of the present invention may contain a catalyst.

Examples of the catalyst include noble metals such as platinum, palladium, and rhodium, alkaline metals such as potassium and sodium, alkaline earth metals such as barium, and metal oxides such as $CeO_2$. Each of these catalysts may be used alone, or two or more of the catalysts may be used in combination.

The mat according to the embodiment of the present invention has a structure in which the virtual straight line L1 and the virtual straight lines L2 intersect with each other at an angle $\alpha$ of less than about 90°, the virtual straight line L1 and the virtual straight lines L3 intersect with each other at the angle $\beta$ of more than about 90°, and the virtual straight lines L2 and the virtual straight lines L3 intersect with each other at a predetermined angle $\gamma$. Such a structure may be appropriately combined with various structures (e.g. composition of the inorganic fibrous substance, fiber length of the inorganic fibrous substance) that have been described in detail for the first embodiment and the other embodiments so as to easily achieve the desired effects.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A method for producing a mat, comprising:

preparing a sheet including inorganic fibrous substance precursors intertwined with each other, a first main face, a second main face opposite to the first main face, a first side face, and a second side face opposite to the first side face, each of the first and second main faces and the first and second side faces being defined by the inorganic fibrous substance precursors;

piercing the sheet with first needles to form first intertwined portion precursors in such a manner that the first needles intersect with a first virtual straight line at a first angle of less than about 90° when viewed from the first side face to the second side face, the first virtual straight line being defined along a direction perpendicular to a thickness direction of the sheet;

piercing the sheet with second needles to form second intertwined portion precursors in such a manner that the second needles intersect with the first virtual straight line at a second angle of more than about 90° and intersect with second virtual straight lines at a third angle when viewed from the first side face to the second side face, the second virtual straight lines being respectively defined along the first intertwined portion precursors; and firing the sheet to convert the inorganic fibrous substance precursors into inorganic fibrous substances after the sheet is pierced with the first and second needles.

2. The method for producing a mat according to claim 1, wherein the first and second needles each include a finely tapered tip and barbs.

3. The method for producing a mat according to claim 1, wherein in the piercing of the sheet, a minimum distance between one needle piercing point and a nearest needle piercing point to the one needle piercing point is from about 1 mm to about 10 mm.

4. The method for producing a mat according to claim 1, wherein in the piercing of the sheet, a diameter of each of the needle piercing points is from about 0.1 mm to about 2 mm.

5. An exhaust gas purifying apparatus comprising:

an exhaust gas treating body;

a casing accommodating the exhaust gas treating body; and a holding sealing material disposed between the exhaust gas treating body and the casing and holding the exhaust gas treating body, the holding sealing material comprising a mat produced by a method comprising:

preparing a sheet including inorganic fibrous substance precursors intertwined with each other, a first main face, a second main face opposite to the first main face, a first side face, and a second side face opposite to the first side face, the first and second main faces and the first and second side faces being each defined by the inorganic fibrous substance precursors;

piercing the sheet with first needles to form first intertwined portion precursors, in such a manner that the first needles intersect with a first virtual straight line at a first angle of less than about 90° when viewed from the first side face to the second side face, the first virtual straight line being defined along a direction perpendicular to a thickness direction of the sheet;

piercing the sheet with second needles to form second intertwined portion precursors, in such a manner that the second needles intersect with the first virtual straight line at a second angle of more than about 90° and intersect with second virtual straight lines at a third angle when viewed from the first side face to the second side face, the second virtual straight lines being respectively defined along the first intertwined portion precursors; and firing the sheet to convert the inorganic fibrous substance precursors into inorganic fibrous substances after the sheet is pierced with the first and second needles.

6. The exhaust gas purifying apparatus according to claim 5, wherein the exhaust gas treating body includes a catalyst.

* * * * *